US010724291B2

(12) United States Patent
Tabadkani et al.

(10) Patent No.: US 10,724,291 B2
(45) Date of Patent: Jul. 28, 2020

(54) SMART TRANSFORMABLE SHADING SYSTEM WITH ADAPTABILITY TO CLIMATE CHANGE

(71) Applicants: Seyed Amir Tabadkani, Khorasan Razavi (IR); Masoud Valinejadshoubi, Mazandaran (IR)

(72) Inventors: Seyed Amir Tabadkani, Khorasan Razavi (IR); Masoud Valinejadshoubi, Mazandaran (IR)

( * ) Notice: Subject to any disclaimer, the term of this patent is extended or adjusted under 35 U.S.C. 154(b) by 295 days.

(21) Appl. No.: 15/937,956

(22) Filed: Mar. 28, 2018

(65) Prior Publication Data

US 2018/0216399 A1 Aug. 2, 2018

(51) Int. Cl.

| | |
|---|---|
| ***E06B 9/24*** | (2006.01) |
| ***E06B 3/67*** | (2006.01) |
| ***E06B 9/68*** | (2006.01) |
| ***E06B 9/322*** | (2006.01) |

(52) U.S. Cl.

CPC ..... *E06B 3/6722* (2013.01); *E06B 9/24* (2013.01); *E06B 9/322* (2013.01); *E06B 9/68* (2013.01); *E06B 2009/2417* (2013.01); *E06B 2009/2423* (2013.01); *E06B 2009/2476* (2013.01); *E06B 2009/2482* (2013.01); *E06B 2009/2488* (2013.01); *E06B 2009/6827* (2013.01); *E06B 2009/6881* (2013.01)

(58) Field of Classification Search

CPC ... E06B 9/68; E06B 9/322; E06B 9/24; E06B 9/262; E06B 9/264; E06B 2009/6881; E06B 2009/2476; E06B 2009/2488; E06B 2009/6827; E06B 2009/2417; E06B 2009/2423; E06B 2009/2482; E06B 3/6722; Y02B 80/50; Y02A 30/257

USPC ..... 160/183, 352

See application file for complete search history.

(56) References Cited

U.S. PATENT DOCUMENTS

| | | | | |
|---|---|---|---|---|
| 6,084,231 A * | 7/2000 | Popat | E06B 9/32 250/214 AL |
| 6,116,320 A * | 9/2000 | Peterson | E06B 9/32 160/84.02 |
| 6,233,881 B1 * | 5/2001 | Rainbolt | E04B 7/14 52/83 |
| 6,239,910 B1 * | 5/2001 | Digert | E06B 9/28 160/104 |
| 7,654,045 B2 * | 2/2010 | Wiegel | E06B 9/06 160/352 |

(Continued)

*Primary Examiner* — Johnnie A. Shablack
(74) *Attorney, Agent, or Firm* — NovoTechIP International PLLC

(57) ABSTRACT

A smart transformable shading system with adaptability to expand and retract in response to solar radiation comprises, in one implementation, a housing unit, a plurality of structural cells, and a plurality of modular units. The structural cells are within the housing unit, and are aligned in first and directions with respect to the housing unit. Each modular unit is placed within a corresponding structural cell, and includes a plurality of structural rings, a plurality of deployable shell panels, a plurality of control units, and a plurality of circuit units. Each circuit unit is connected to a corresponding control unit, which in turn is connected to a corresponding deployable shell panel, the combination of which is placed within a corresponding structural ring to transform into different geometries in response to light.

20 Claims, 23 Drawing Sheets

(56) References Cited

U.S. PATENT DOCUMENTS

| | | | | |
|---|---|---|---|---|
| 9,567,799 | B2 | 2/2017 | Klettke | |
| 9,624,719 | B2 | 4/2017 | Rupel | |
| 9,657,515 | B2 | 5/2017 | Rupel | |
| 9,702,185 | B2 | 7/2017 | Jelic et al. | |
| 9,732,554 | B2 | 8/2017 | Teuscher | |
| 10,167,667 | B2 * | 1/2019 | Patel | E06B 9/32 |
| 10,526,770 | B2 * | 1/2020 | Valinejadshoubi | E04B 1/7645 |
| 2003/0192651 | A1 | 10/2003 | Jelic et al. | |
| 2005/0083593 | A1 * | 4/2005 | Addison | B44F 1/06 359/837 |
| 2007/0163732 | A1 * | 7/2007 | Konstantin | A47H 23/06 160/237 |
| 2013/0037224 | A1 * | 2/2013 | Zhang | E06B 9/30 160/220 |
| 2013/0175423 | A1 * | 7/2013 | Coberly | F16M 11/10 248/558 |
| 2015/0101761 | A1 * | 4/2015 | Moslehi | E06B 9/386 160/107 |
| 2016/0237741 | A1 * | 8/2016 | Greene | E06B 9/32 |
| 2017/0122030 | A1 | 5/2017 | Zhang et al. | |
| 2017/0293270 | A1 * | 10/2017 | Marik | G05B 13/0265 |
| 2017/0363897 | A1 * | 12/2017 | Martin | E06B 9/24 |
| 2018/0010386 | A1 * | 1/2018 | Teuscher | E06B 9/362 |
| 2018/0119481 | A1 * | 5/2018 | Ghanizadehgrayli | F24F 7/00 |
| 2018/0216399 | A1 * | 8/2018 | Tabadkani | E06B 9/24 |
| 2018/0284555 | A1 * | 10/2018 | Klawuhn | G02F 1/163 |
| 2018/0291681 | A1 * | 10/2018 | Kanno | E06B 9/266 |
| 2019/0195012 | A1 * | 6/2019 | Nagamine | A61B 5/16 |
| 2019/0257686 | A1 * | 8/2019 | Popat | G01J 1/0474 |

* cited by examiner

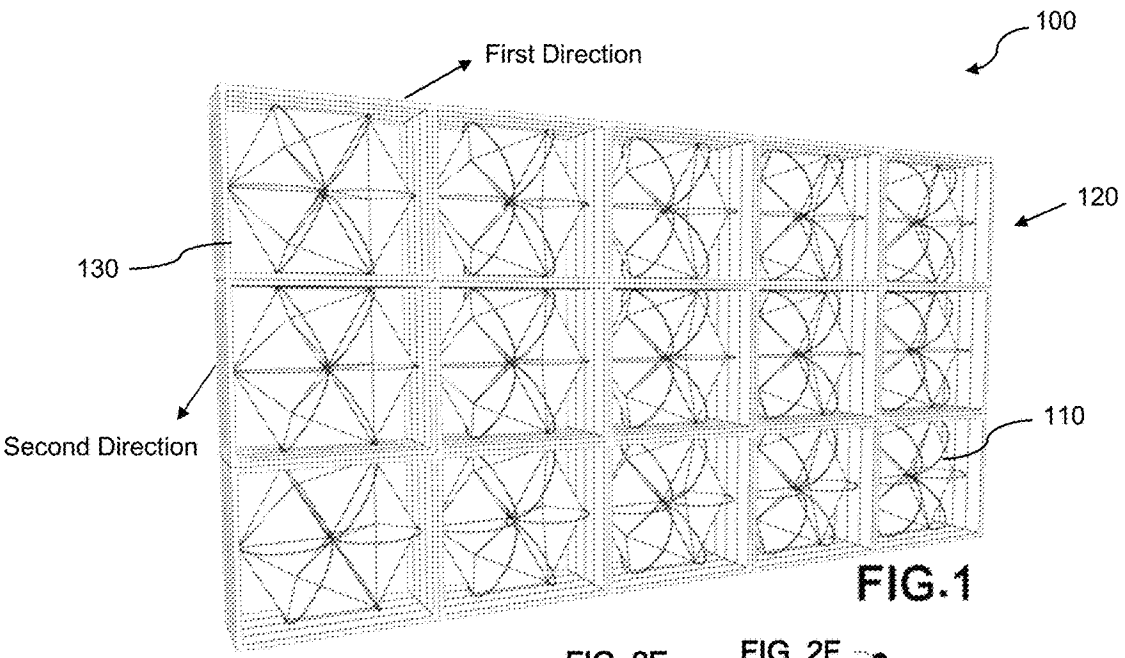
FIG. 1
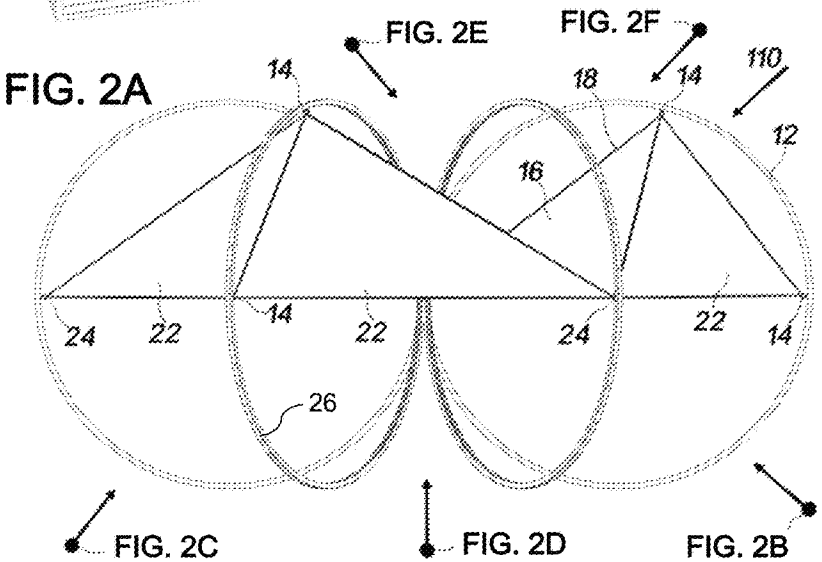

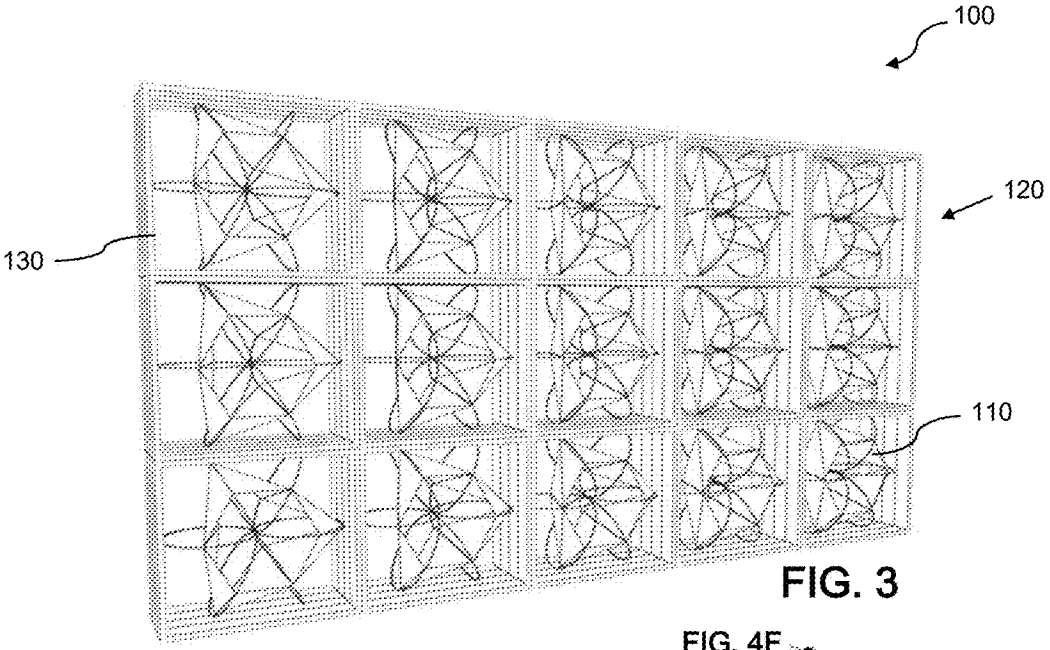
FIG. 3
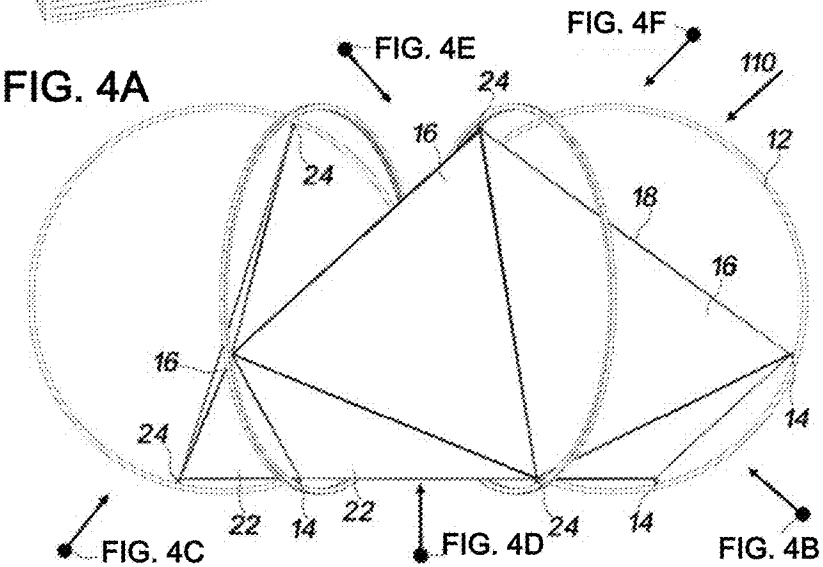

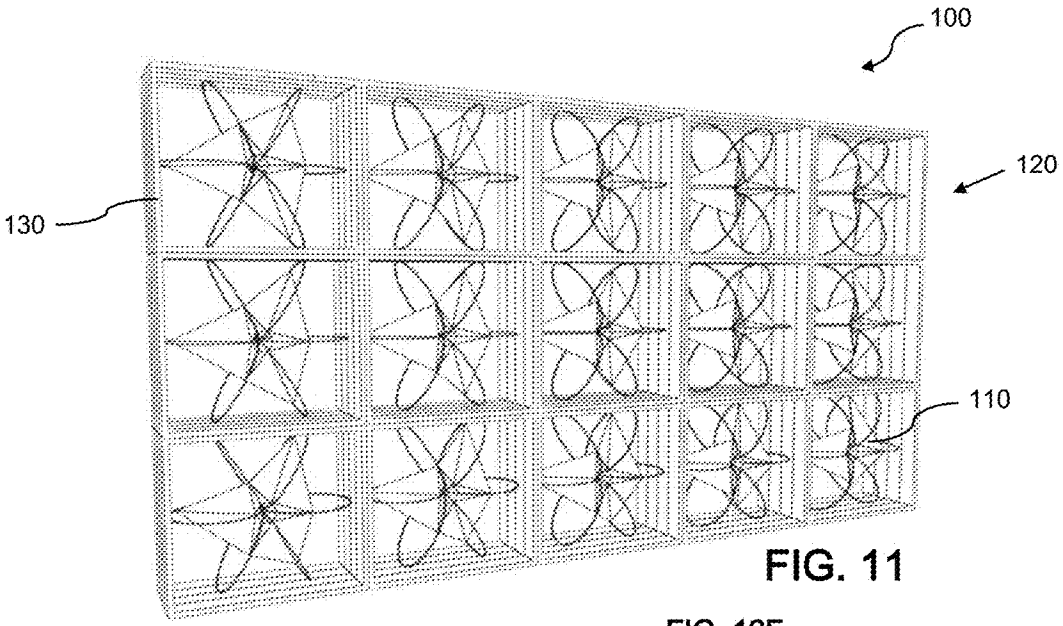
FIG. 11
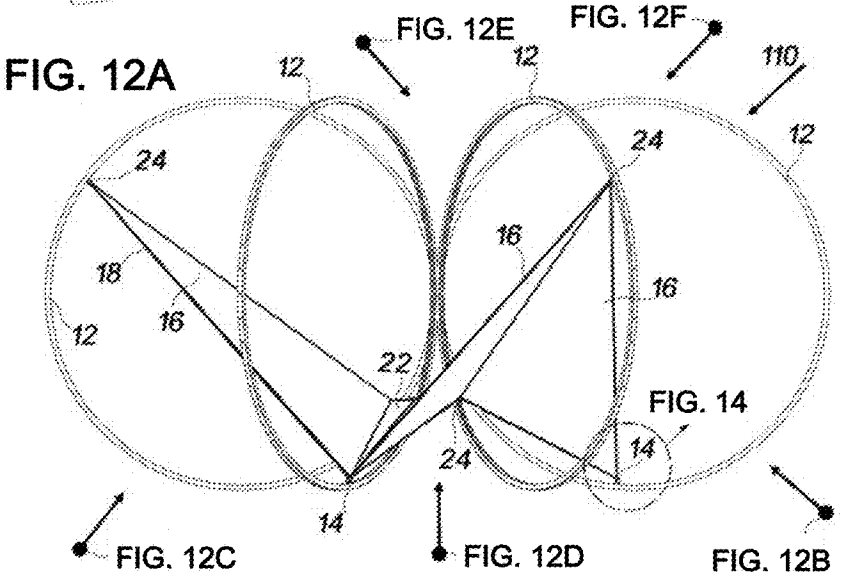

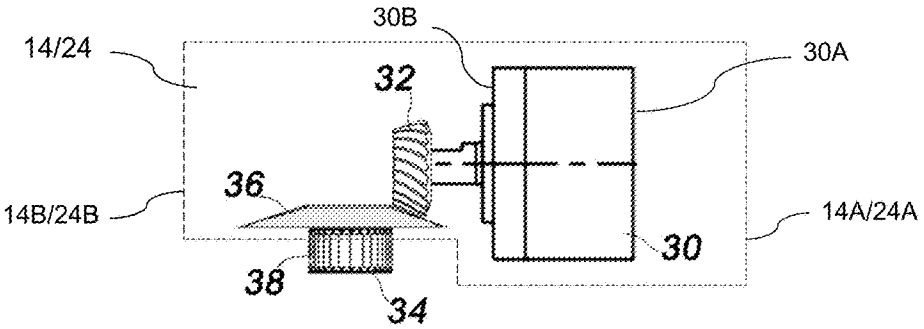
FIG. 14
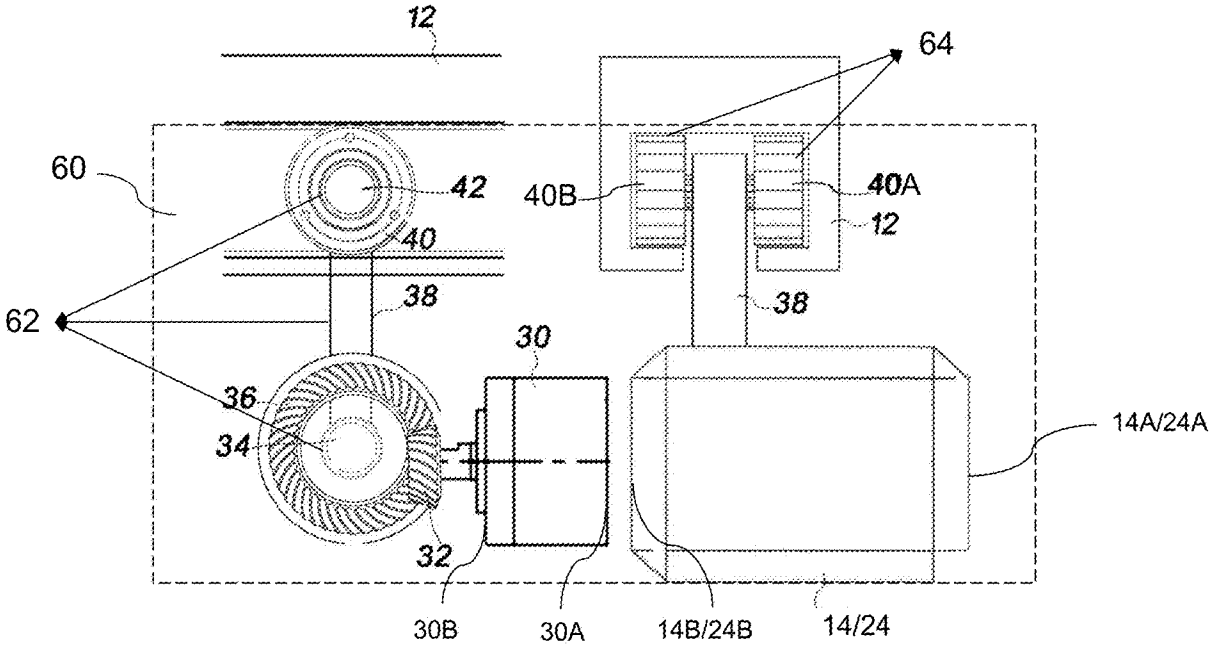
FIG. 15A
FIG. 15B

Timing One – P 0

| $UDI_{300}$ | $UDI_{2000}$ | $UDI_{100}$ | Daylight Performance | DGP0 | DGP1 | DGP2 | 1st Module Mat. | 2nd Module Mat. | Hour |
|---|---|---|---|---|---|---|---|---|---|
| 63.64 | 15.38 | 0.00 | 48.25 | 0.23 | 0.37 | 0.29 | 4 | 4 | 8508 |
| 58.74 | 10.49 | 0.00 | 48.25 | 0.22 | 0.35 | 0.28 | 4 | 0 | 8508 |
| 58.04 | 14.69 | 0.00 | 43.36 | 0.22 | 0.34 | 0.28 | 4 | 3 | 8508 |
| 57.34 | 6.99 | 0.00 | 50.35 | 0.23 | 0.36 | 0.28 | 4 | 4 | 1908 |
| 55.94 | 6.29 | 0.00 | 49.65 | 0.23 | 0.36 | 0.28 | 4 | 4 | 6324 |
| 55.94 | 10.49 | 0.70 | 45.45 | 0.22 | 0.35 | 0.28 | 4 | 2 | 8508 |
| 53.85 | 7.69 | 0.70 | 46.15 | 0.22 | 0.34 | 0.28 | 4 | 1 | 8508 |
| 51.05 | 4.90 | 5.59 | 46.15 | 0.22 | 0.35 | 0.27 | 4 | 2 | 1908 |
| 50.35 | 2.10 | 6.99 | 48.25 | 0.22 | 0.35 | 0.27 | 4 | 3 | 6324 |
| 50.35 | 5.59 | 5.59 | 44.76 | 0.22 | 0.35 | 0.27 | 4 | 0 | 1908 |

Timing One – P 0.2

| $UDI_{300}$ | $UDI_{2000}$ | $UDI_{100}$ | Daylight Performance | DGP0 | DGP1 | DGP2 | 1st Module Mat. | 2nd Module Mat. | Hour |
|---|---|---|---|---|---|---|---|---|---|
| 80.42 | 15.38 | 0.00 | 65.03 | 0.24 | 0.41 | 0.30 | 4 | 4 | 8508 |
| 76.92 | 11.89 | 0.00 | 65.03 | 0.23 | 0.39 | 0.30 | 4 | 3 | 8508 |
| 76.22 | 10.49 | 0.00 | 65.73 | 0.23 | 0.38 | 0.29 | 1 | 4 | 8508 |
| 75.52 | 11.89 | 0.00 | 63.64 | 0.23 | 0.39 | 0.30 | 4 | 2 | 8508 |
| 74.83 | 12.59 | 0.00 | 62.24 | 0.23 | 0.38 | 0.29 | 0 | 4 | 8508 |
| 74.83 | 13.29 | 0.00 | 61.54 | 0.23 | 0.38 | 0.30 | 4 | 1 | 8508 |
| 74.13 | 12.59 | 0.00 | 61.54 | 0.23 | 0.39 | 0.30 | 4 | 0 | 8508 |
| 72.73 | 9.79 | 0.00 | 62.94 | 0.22 | 0.36 | 0.28 | 0 | 0 | 8508 |
| 72.73 | 10.49 | 0.00 | 62.24 | 0.22 | 0.37 | 0.29 | 3 | 3 | 8508 |
| 72.03 | 10.49 | 0.00 | 61.54 | 0.22 | 0.37 | 0.29 | 1 | 3 | 8508 |

FIG. 18

Timing One – P 0.4

| $UDI_{300}$ | $UDI_{2000}$ | $UDI_{100}$ | Daylight Performance | DGP0 | DGP1 | DGP2 | 1st Module Mat. | 2nd Module Mat. | Hour |
|---|---|---|---|---|---|---|---|---|---|
| 67.13 | 15.38 | 0.00 | 51.75 | 0.24 | 0.40 | 0.30 | 4 | 4 | 8508 |
| 66.43 | 13.99 | 0.00 | 52.45 | 0.23 | 0.38 | 0.30 | 4 | 3 | 8508 |
| 65.73 | 13.99 | 0.00 | 51.75 | 0.23 | 0.38 | 0.30 | 4 | 0 | 8508 |
| 65.73 | 13.99 | 0.00 | 51.75 | 0.23 | 0.38 | 0.30 | 4 | 2 | 8508 |
| 65.03 | 13.29 | 0.00 | 51.75 | 0.23 | 0.38 | 0.30 | 4 | 1 | 8508 |
| 59.44 | 6.29 | 0.00 | 53.15 | 0.23 | 0.37 | 0.28 | 4 | 1 | 1908 |
| 59.44 | 6.29 | 0.00 | 53.15 | 0.23 | 0.38 | 0.29 | 4 | 4 | 1908 |
| 59.44 | 5.59 | 0.00 | 53.85 | 0.23 | 0.38 | 0.29 | 4 | 4 | 6324 |
| 58.74 | 5.59 | 0.00 | 53.15 | 0.23 | 0.38 | 0.29 | 4 | 0 | 1908 |
| 58.74 | 6.29 | 0.00 | 52.45 | 0.23 | 0.37 | 0.28 | 4 | 3 | 1908 |

Timing Two – P 0

| $UDI_{300}$ | $UDI_{2000}$ | $UDI_{100}$ | Daylight Performance | DGP0 | DGP1 | DGP2 | 1st Module Mat. | 2nd Module Mat. | Hour |
|---|---|---|---|---|---|---|---|---|---|
| 64.34 | 13.99 | 0.00 | 50.35 | 0.23 | 0.38 | 0.30 | 4 | 4 | 8508 |
| 62.94 | 11.89 | 0.00 | 51.05 | 0.23 | 0.38 | 0.29 | 0 | 4 | 8508 |
| 62.94 | 12.59 | 0.00 | 50.35 | 0.23 | 0.38 | 0.29 | 1 | 4 | 8508 |
| 62.24 | 10.49 | 0.00 | 51.75 | 0.23 | 0.38 | 0.30 | 3 | 4 | 8508 |
| 61.54 | 11.89 | 0.00 | 49.65 | 0.23 | 0.37 | 0.29 | 2 | 4 | 8508 |
| 58.74 | 5.59 | 0.00 | 53.15 | 0.23 | 0.37 | 0.29 | 4 | 4 | 1908 |
| 58.04 | 4.20 | 0.00 | 53.85 | 0.23 | 0.37 | 0.29 | 4 | 4 | 6324 |
| 55.94 | 3.50 | 0.00 | 52.45 | 0.23 | 0.37 | 0.29 | 0 | 4 | 1908 |
| 55.94 | 2.80 | 0.00 | 53.15 | 0.23 | 0.36 | 0.28 | 3 | 4 | 6324 |
| 55.24 | 4.20 | 0.00 | 51.05 | 0.23 | 0.36 | 0.28 | 2 | 4 | 1908 |

FIG. 19

BEST AVAILABLE IMAGE

Timing Two – P 0.2

| $UDI_{300}$ | $UDI_{2000}$ | $UDI_{100}$ | Daylight Performance | DGP0 | DGP1 | DGP2 | 1st Module Mat. | 2nd Module Mat. | Hour |
|---|---|---|---|---|---|---|---|---|---|
| 91.61 | 15.38 | 0.00 | 76.22 | 0.24 | 0.42 | 0.31 | 4 | 4 | 8508 |
| 89.51 | 16.08 | 0.00 | 73.43 | 0.24 | 0.42 | 0.31 | 4 | 0 | 8508 |
| 88.81 | 15.38 | 0.00 | 73.43 | 0.24 | 0.42 | 0.31 | 4 | 2 | 8508 |
| 88.81 | 16.08 | 0.00 | 72.73 | 0.24 | 0.42 | 0.31 | 4 | 3 | 8508 |
| 88.81 | 15.38 | 0.00 | 73.43 | 0.24 | 0.42 | 0.31 | 4 | 1 | 8508 |
| 84.62 | 13.99 | 0.00 | 70.63 | 0.24 | 0.40 | 0.30 | 3 | 4 | 8508 |
| 84.62 | 14.69 | 0.00 | 69.93 | 0.23 | 0.40 | 0.30 | 1 | 4 | 8508 |
| 83.92 | 13.99 | 0.00 | 69.93 | 0.23 | 0.39 | 0.30 | 1 | 1 | 8508 |
| 83.22 | 13.99 | 0.00 | 69.23 | 0.23 | 0.40 | 0.30 | 3 | 2 | 8508 |
| 83.22 | 13.99 | 0.00 | 69.23 | 0.23 | 0.40 | 0.30 | 3 | 1 | 8508 |

Timing Two – P 0.4

| $UDI_{300}$ | $UDI_{2000}$ | $UDI_{100}$ | Daylight Performance | DGP0 | DGP1 | DGP2 | 1st Module Mat. | 2nd Module Mat. | Hour |
|---|---|---|---|---|---|---|---|---|---|
| 87.41 | 17.48 | 0.00 | 69.93 | 0.24 | 0.43 | 0.32 | 4 | 4 | 8508 |
| 86.71 | 15.38 | 0.00 | 71.33 | 0.24 | 0.43 | 0.32 | 4 | 2 | 8508 |
| 86.71 | 18.18 | 0.00 | 68.53 | 0.24 | 0.42 | 0.31 | 4 | 0 | 8508 |
| 86.01 | 15.38 | 0.00 | 70.63 | 0.24 | 0.41 | 0.30 | 4 | 4 | 8508 |
| 86.01 | 18.18 | 0.00 | 67.83 | 0.24 | 0.43 | 0.31 | 4 | 3 | 8508 |
| 85.31 | 15.38 | 0.00 | 69.93 | 0.24 | 0.42 | 0.31 | 4 | 1 | 8508 |
| 76.92 | 9.79 | 0.00 | 67.13 | 0.23 | 0.39 | 0.29 | 0 | 3 | 8508 |
| 75.52 | 10.49 | 0.00 | 65.03 | 0.23 | 0.38 | 0.29 | 0 | 1 | 8508 |

FIG. 20

SMART TRANSFORMABLE SHADING SYSTEM WITH ADAPTABILITY TO CLIMATE CHANGE

CROSS REFERENCE TO RELATED APPLICATION

This application claims the benefit of priority to Iran Application Serial Number 139650140003004325, filed on Jul. 7, 2017, the entire content of which is incorporated herein by reference.

TECHNICAL FIELD

The present disclosure relates generally to shading systems and, more particularly, to smart transformable shading systems adaptable to climate change.

BACKGROUND

Transformable shading systems have become a popular type of building façade coverings in various residential and commercial applications. The transformable shading systems are aesthetically attractive while providing improved insulation across a window or other type of opening due to their modular construction. The design emphasis in various building structures has maintained pressure on the industry to continue to create unique aesthetically attractive coverings for architectural openings. Although the introduction of transformable shading systems has greatly benefited the industry in this regard, there remains a need to create smart transformable shading systems having adaptability to climate change, and capability to be optimized based on various parameters such as vision comfort, vision field, Useful Daylight Illuminance (UDI), Daylight Glare Probability (DGP), and Daylight Glare Index (DGI). While these parameters can directly impact illuminating or lighting effects perceived by occupants inside a subject unit, the shading system optimization based on such parameters can ultimately improve the annual energy consumption of the subject unit.

Accordingly, there is a need for providing a smart system and method for transformable shading system with motion flexibility to different timings and geometric adaptability to climate change.

SUMMARY

In one general aspect, described is a transformable shading system configured to be adaptable to climate change while providing comfortable shading to users. The transformable shading system may include a housing unit having portions in first and second directions, for example, linear orientations, which may be perpendicular to one another; a plurality of structural cells distributed in an array aligned with respect to the first and second directions of the housing unit; and a plurality of modular units, each positioned within each of the plurality of the structural cells, and configured to expand and retract into different geometric transformations in response to sun radiation, and a user's needs in a subject unit.

In an aspect, each structural cell may include a structural frame, a plurality of connections, and a structural frame cover, and may surround a corresponding one of the modular units. Each modular unit may include a plurality of structural rings, a fastening connection, a plurality of deployable shell panels, a plurality of control units, and a plurality of circuit units. Each structural ring may include a first connection, a second connection, and a surrounding rail in which six of the structural rings are positioned within each of the plurality of the structural cells such that each of the first connections of the six structural rings is attached to a corresponding one of the connections of the structural frame of the structural cell; and each of the second connections of the six structural rings is attached together by the fastening connection of the modular unit.

In a related aspect, each deployable shell panel may include a plurality of connections and a plurality of deployable pipes, where each deployable pipe is configured to define a margin of the deployable shell panel, and to connect to corresponding control units via corresponding connections. Each circuit unit may connect to a corresponding one of the control units and may subsequently control the motion of a corresponding one of the deployable shell panels connected to such control unit.

The foregoing and other objects, features, aspects, and advantages of the present invention will become more apparent from the following detailed description of the present application when taken in conjunction with the accompanying drawings.

BRIEF DESCRIPTION OF THE DRAWINGS

Features of the subject technology are set forth in the appended claims. However, for purpose of explanation, several implementations of the subject technology are set forth in the following figures.

FIG. 1 illustrates an exemplary smart transformable shading system, in an aspect of a geometric transformation at one specific timing and at one specific user positioning from a spatial perspective: Timing One-Position 0 (or P0), in accordance with one or more implementations.

FIG. 2A illustrates an exemplary modular unit, in an aspect of a geometric transformation at Timing One-P0, in accordance with one or more implementations.

FIG. 3 illustrates an exemplary smart transformable shading system, in an aspect of a geometric transformation at one specific timing and at one specific user positioning from a spatial perspective: Timing One-Position 0.2 (or P0.2), in accordance with one or more implementations.

FIG. 4A illustrates an exemplary modular unit, in an aspect of a geometric transformation at Timing One-P0.2, in accordance with one or more implementations.

FIG. 11 illustrates an exemplary smart transformable shading system, in an aspect of a geometric transformation at one specific timing and at one specific user positioning from a spatial perspective: Timing Two-Position 0.4 (or P0.4), in accordance with one or more implementations.

FIG. 12A illustrates an exemplary modular unit, in an aspect of a geometric transformation at Timing Two-P0.4, in accordance with one or more implementations.

FIG. 14 illustrates an exemplary side view of a gear box and part of a cylindrical unit, in accordance with one or more implementations.

FIG. 15A illustrates an exemplary control unit in an example arrangement within a structural ring, in accordance with one or more implementations.

FIG. 15B illustrates an exemplary side view of the control unit in an example arrangement within a structural ring, in accordance with one or more implementations.

FIG. 18 illustrates exemplary data sets representing aspects of various operations in geometric transformations of the transformable shading system at Timing One-P0 and Timing One-P0.2, in accordance with one or more implementations.

FIG. 19 illustrates exemplary data sets representing aspects of various operations in geometric transformations of the transformable shading system at Timing One-P0.4 and Timing Two-P0, in accordance with one or more implementations.

FIG. 20 illustrates exemplary data sets representing aspects of various operations in geometric transformations of the transformable shading system at Timing Two-P0.2 and Timing Two-P0.4, in accordance with one or more implementations.

DETAILED DESCRIPTION

Figures 2B, 2C, 2D, 2E, 2F:
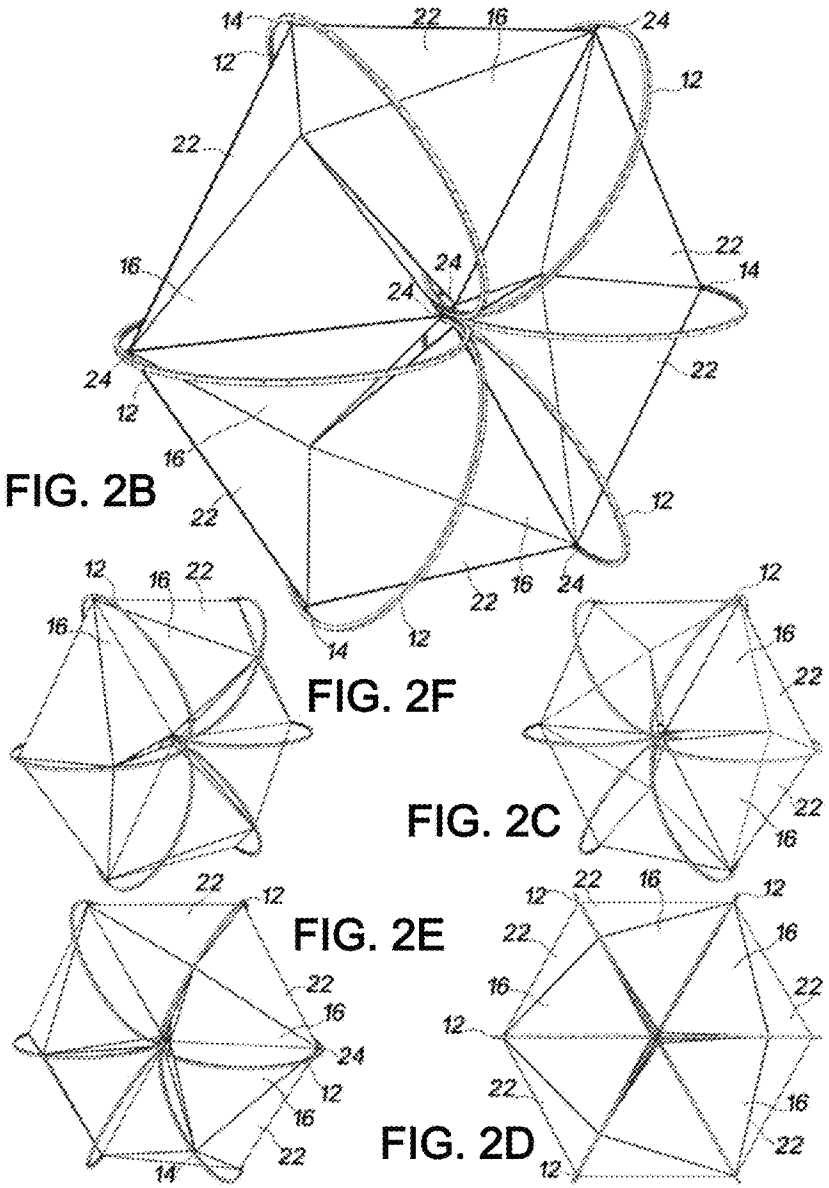
FIG. 2B through FIG. 2F illustrate aspects of an exemplary geometric transformation of the modular unit at Timing One-P0, viewed from example projections marked with arrows in FIG. 2A, in accordance with one or more implementations.
Figures 4B, 4C, 4D, 4E, 4F:
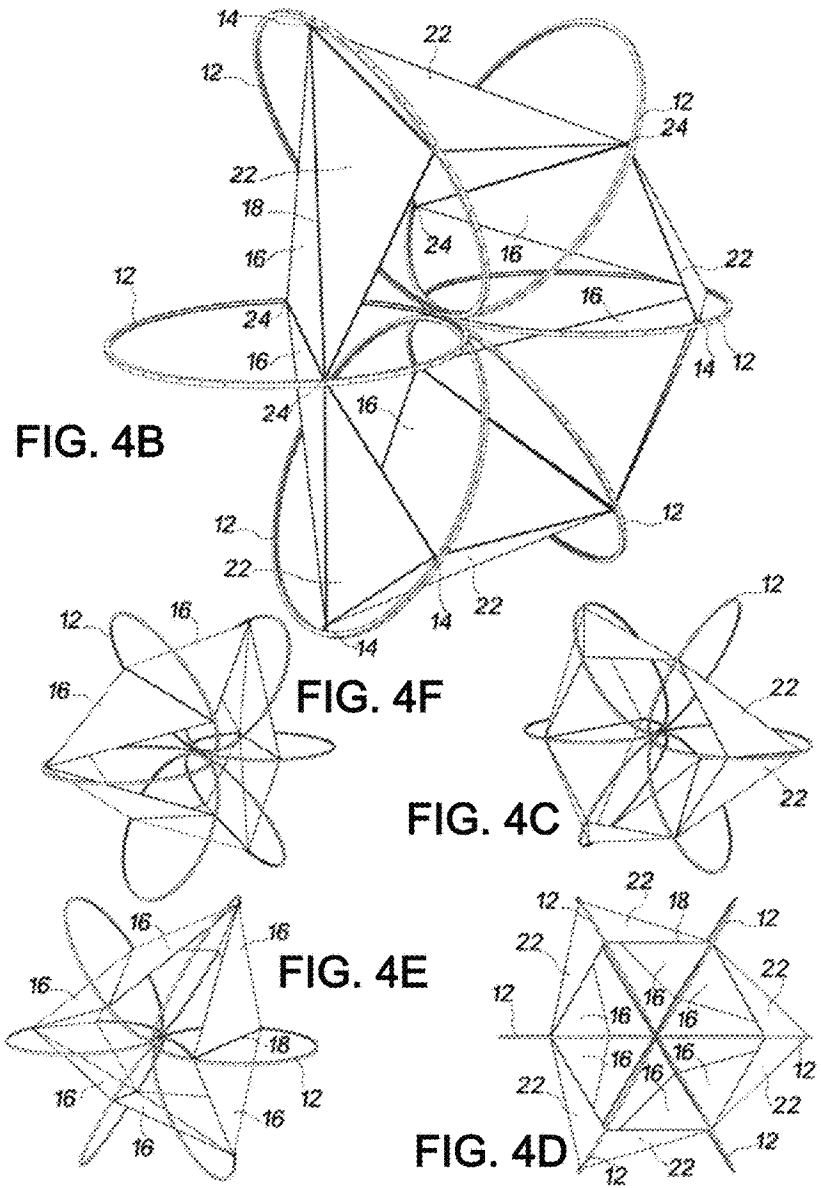
FIG. 4B through FIG. 4F illustrate aspects of an exemplary geometric transformation of the modular unit at Timing One-P0.2, viewed from example projections marked with arrows in FIG. 4A, in accordance with one or more implementations.

In the following detailed description, numerous specific details are set forth by way of examples in order to provide a thorough understanding of the relevant teachings. However, it should be apparent to those skilled in the art that the present teachings may be practiced without such details. In other instances, well-known methods, procedures, components, and/or circuitry have been described at a relatively high-level, without detail, in order to avoid unnecessarily obscuring aspects of the present teachings. As part of the description, some of this disclosure's drawings represent structures and devices in block diagram form in order to avoid obscuring the invention. In the interest of clarity, not all features of an actual implementation are described in this specification. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" means that a particular feature, structure, or characteristic described in connection with the embodiment is included in at least one embodiment of the invention, and multiple references to "one embodiment" or "an embodiment" should not be understood as necessarily all referring to the same embodiment.

Transformable shading systems currently available in the market mainly focus on designs to provide sunshades not necessarily based on parameters with human perceptions and environmental conditions. As such, there remains a need to create smart transformable shading systems having the adaptability to climate change, and capability of optimization based on various parameters such as vision comfort, vision field, Useful Daylight Illuminance (UDI), Daylight Glare Probability (DGP), and Daylight Glare Index (DGI).

Disclosed systems and methods can provide solutions to these and other technical problems. Technical features can include, and provide various optimizations, based on parameters such as the examples above, as well as combinations and sub-combinations thereof. Optimizations can include, and can be variously configured, as will be described in greater detail, to provide improved quality and certainty of design, with respect to illumination and lighting effects. Optimizations can adapt, and be directed to "hard" metrics and, for example, can weigh metrics of perceptions by occupants inside a subject unit. Technical features can also include, but are not limited to, reduction in annual energy consumption of the subject unit. An improved transformable shading system can apply various origami structural arrangements and can provide motion flexibility to different timings and geometric adaptability to climate change. Additionally, the improved transformable shading system can be automatically programmed by utilizing smart digital sensors to effectively control such geometric transformations in response to electromagnetic radiation.

Principles of the present invention will now be described in detail with reference to the examples illustrated in the accompanying drawings and discussed below. FIG. 1 illustrates an implementation of an exemplary transformable shading system 100 (hereinafter "system 100") that can be used to expand and retract in response to solar radiation. Implementations of the system 100 can include, for example, a housing unit 120, a plurality of structural cells 130, and a plurality of modular units 110. In one implementation, the housing unit 120 as shown can include portions having first and second directions, for example, linear orientations, which may be but are not necessarily perpendicular to each other. The plurality of structural cells 130 can extend in an array aligned with the first and second directions of the housing unit 120.

FIG. 2A illustrates an exemplary modular unit 110 that can be configured to automatically transform into different geometries in response to solar radiation. In the FIG. 2A implementation, the modular unit 110 can include a plurality of structural rings 12, a plurality of deployable shell panels 16 and 22, a plurality of structural pipes 18, and a plurality of gear boxes shown symbolically at junctions 24 and 14. In one implementation, the plurality of the structural rings 12 can include, for example, six structural rings 12, and six corresponding surrounding rails 26. The plurality of deployable shell panels may have a first group 16 including six deployable shell panels, and a second group 22 including six deployable shell panels. One of the deployable shell panels forming the first group 16 and one of the deployable shell panels forming the second group 22 can be positioned within each of the six structural rings 12 of the modular unit 110. The plurality of structural pipes 18 may be configured to define a margin of each of the deployable shell panels 16 and 22. In an aspect, the plurality of structural pipes 18 of each of the deployable shell panels can be formed of flexible materials including plastics.

In one implementation, the six deployable shell panels within the first group of the deployable shell panels 16 may be configured to move together, i.e., simultaneously or partially simultaneously, and to transform into common geometries. The six deployable shell panels within the second group of the deployable shell panels 22 may similarly be configured to move together, i.e., simultaneously or partially simultaneously, and to transform into common geometries. The six deployable shell panels within the first group of the deployable shell panels 16 can be made of materials with common properties; and the six deployable shell panels within the second group of the deployable shell panels 22 can be made of materials with common properties. In an aspect, the first group 16 and the second group 22 of the deployable shell panels can be formed of flexible materials such as natural rubber or highly flexible polyurethane to support desired positions and geometries. In a further aspect, the first group 16 and the second group 22 of the deployable shell panels can be made of materials with different properties but still possessing a similar range of flexibilities in order to geometrically transform the system 100 in a coordinated fashion.

In one implementation, the plurality of the gear boxes may have a first group 24 including six gear boxes, and a second group 14 including six gear boxes. Each of the gear boxes in the first and second groups, 24 and 14, may be connected to each of the deployable shell panels in the first and second groups, 16 and 22, and may affect the motion of such deployable shell panels in respect to one another. The six gear boxes within the first group of the gear boxes 24 may be configured to function together in a cooperative manner, and to move the six deployable shell panels within the first group of the deployable shell panels 16 around the surrounding rail 26 of each of the structural rings 12. The six gear boxes within the second group of the gear boxes 14 may similarly be configured to function together in a cooperative manner, and to move the six deployable shell panels within the second group of the deployable shell panels 22 around the surrounding rail 26 of each of the structural rings 12. The structural positioning of the gear boxes 24 and 14 within the surrounding rail 26 of each of the structural rings 12, and the timing motion of such gear boxes in respect to one another can selectively change based on a user's need. In an aspect, a user may control the structural positioning and the timing motion of the gear boxes 24 and 14 receptive to different environmental conditions by using indoor/outdoor sensors. The indoor sensor may include a thermometer, and the outdoor sensor may include an ultra-violet (UV) index sensor. In another aspect, a user may control the structural positioning and the timing motion of the gear boxes 24 and 14 receptive to different environmental conditions without using any sensors. In a further aspect, the structural positioning and the timing motion of the gear boxes 24 and 14 in turn may command or control each of the deployable shell panels 16 and 22 within each of the structural rings 12 to transform into a separate geometry, in which each of which geometry can be applied to one specific geographical positioning and functioning of the system 100. In a related aspect, the gear boxes 24 and 14 may be configured to work with a dc power supply of, e.g., 12 v and a rotational frequency of, e.g., 50 rpm.

FIG. 2B through FIG. 2F illustrate an exemplary geometric transformation of the modular unit 110 at one specific timing and at one specific user positioning from a spatial perspective: Timing One-Position 0 (or P0), in reference to FIG. 13. In the FIG. 2B through FIG. 2F implementation, the geometric transformation of the modular unit 110 at the Timing One-P0 can be viewed from example projections, which are marked with arrows in FIG. 2A. In one implementation, the six structural rings 12 of the modular unit 110 may form a hexagon in which each diagonal of the hexagon can be configured as a diagonal of each of the six structural rings. The six structural rings 12 of the modular unit 110 may be arranged to construct a stable structural unit, and to support the deployable shell panels 16 and 22 while transforming into different geometries in response to light.

FIG. 3 illustrates an exemplary implementation of system 100 that can provide, among other features, expansion and retraction in response to electromagnetic radiation, at one specific timing and at one specific user positioning from a spatial perspective: Timing One-Position 0.2 (or P0.2), in reference to FIG. 13. In this exemplary implementation, FIG. 4B through FIG. 4F illustrate an exemplary geometric transformation of the modular unit 110 at the Timing One-P0.2. The geometric transformation of the modular unit 110 at the Timing One-P0.2 can be viewed from example projections, which are marked with arrows in FIG. 4A.

Figure 5:
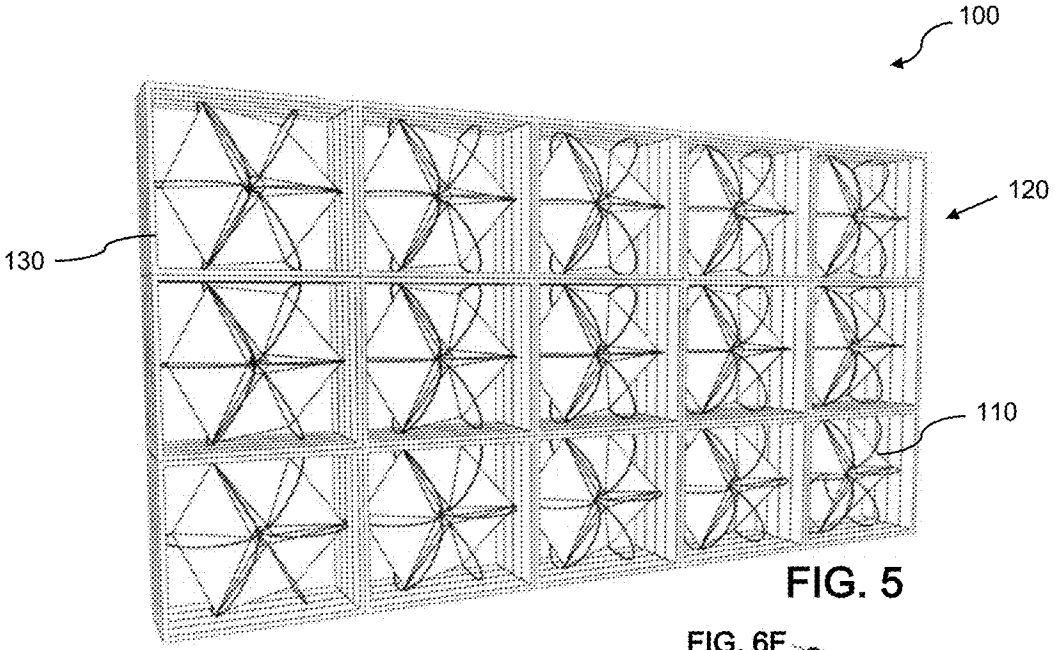
FIG. 5 illustrates an exemplary smart transformable shading system, in an aspect of a geometric transformation at one specific timing and at one specific user positioning from a spatial perspective: Timing One-Position 0.4 (or P0.4), in accordance with one or more implementations.
Figure 6A:
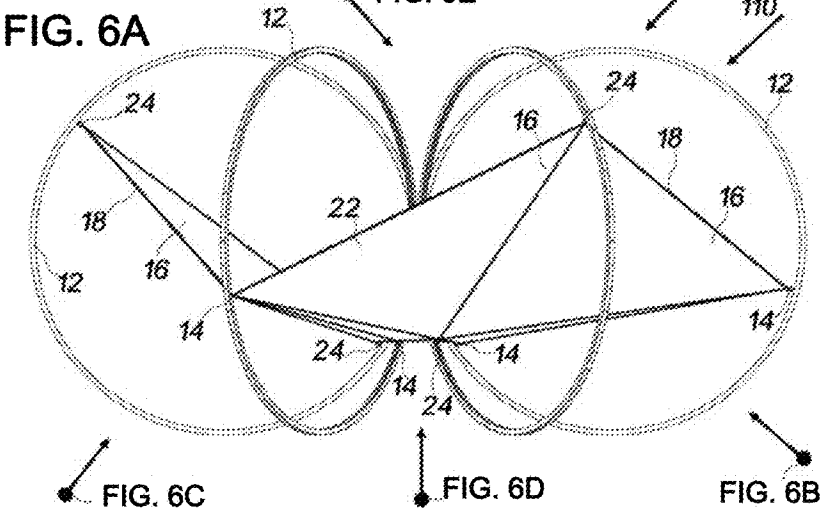
FIG. 6A illustrates an exemplary modular unit, in an aspect of a geometric transformation at Timing One-P0.4, in accordance with one or more implementations.
Figures 6B, 6C, 6D, 6E, 6F:
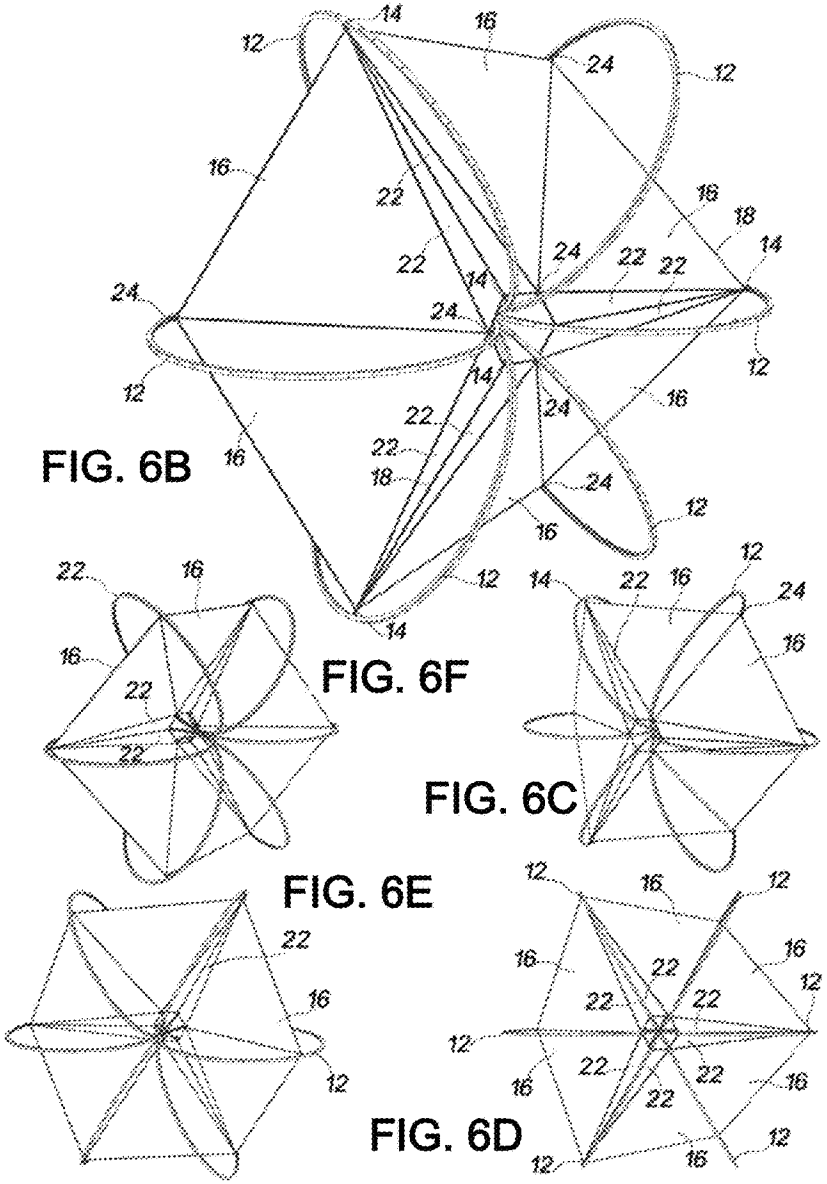
FIG. 6B through FIG. 6F illustrate aspects of an exemplary geometric transformation of the modular unit at Timing One-P0.4, viewed from example projections marked with arrows in FIG. 6A, in accordance with one or more implementations.

FIG. 5 illustrates another implementation of system 100 that can provide, among other features, expansion and retraction in response to electromagnetic radiation according to another specific timing and specific user positioning from a spatial perspective: Timing One-Position 0.4 (or P0.4), in reference to FIG. 13. In this exemplary implementation, FIG. 6B through FIG. 6F illustrate an exemplary geometric transformation of the modular unit 110 at the Timing One-P0.4. The geometric transformation of the modular unit 110 at the Timing One-P0.4 can be viewed from example projections, which are marked with arrows in FIG. 6A.

Figure 7:
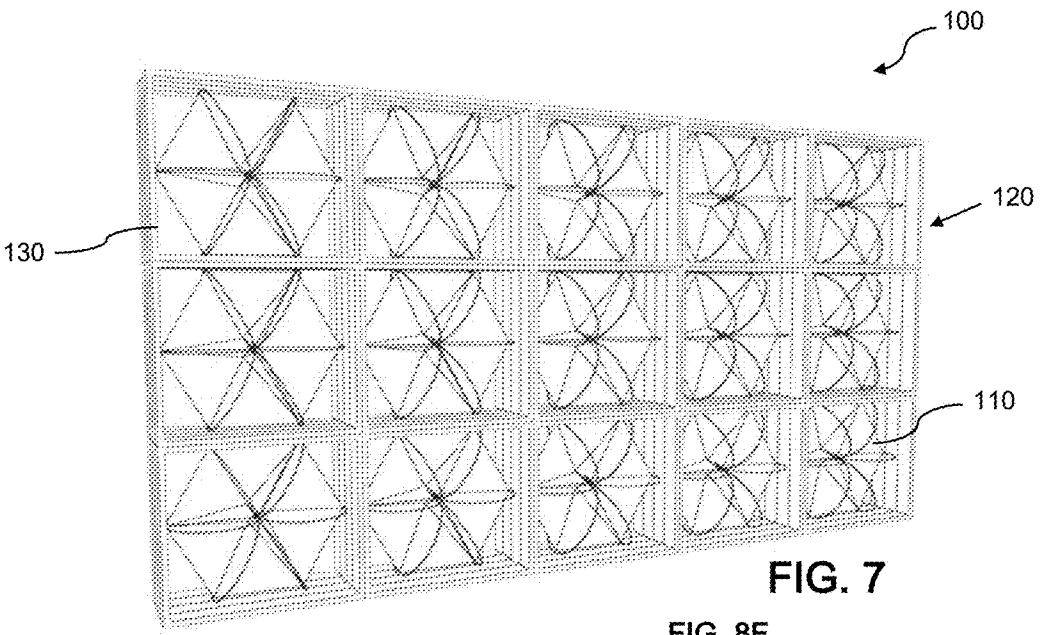
FIG. 7 illustrates an exemplary smart transformable shading system, in an aspect of a geometric transformation at one specific timing and at one specific user positioning from a spatial perspective: Timing Two-Position 0 (or P0), in accordance with one or more implementations.
Figure 8A:
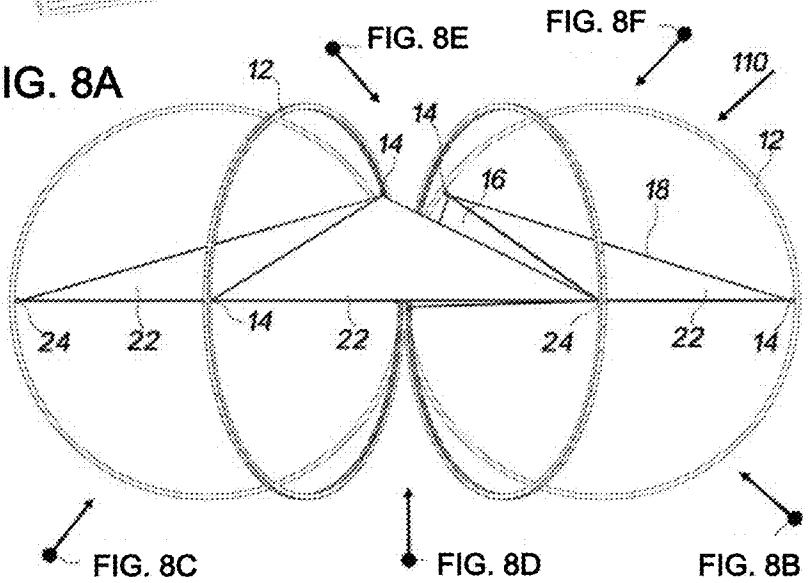
FIG. 8A illustrates an exemplary modular unit, in an aspect of a geometric transformation at Timing Two-P0, in accordance with one or more implementations.
Figures 8B, 8C, 8D, 8E, 8F:
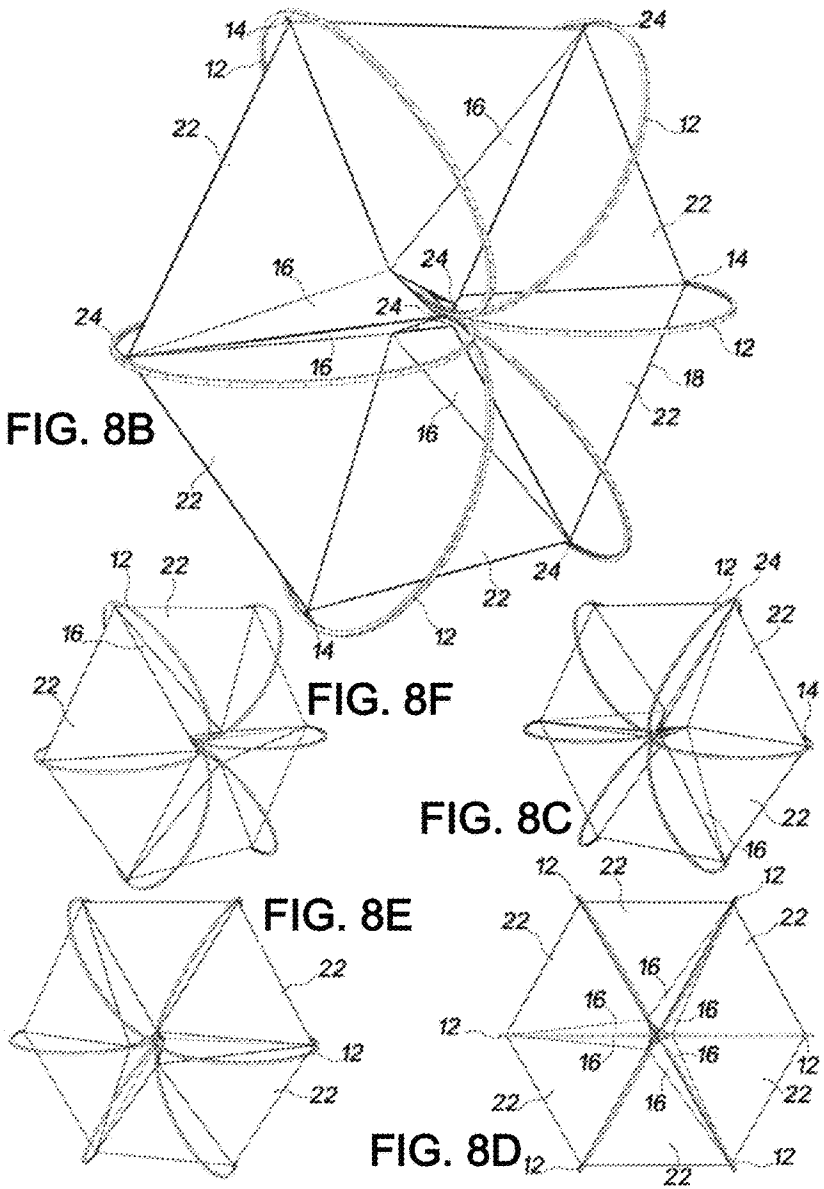
FIG. 8B through FIG. 8F illustrate aspects of an exemplary geometric transformation of the modular unit at Timing Two-P0, viewed from example projections marked with arrows in FIG. 8A, in accordance with one or more implementations.

FIG. 7 illustrates another implementation of system 100 that can provide, among other features, expansion, and retraction in response to electromagnetic radiation according to another specific timing and specific user positioning from a spatial perspective: Timing Two-Position 0 (or P0), in reference to FIG. 13. In this exemplary implementation, FIG. 8B through FIG. 8F illustrate an exemplary geometric transformation of the modular unit 110 at the Timing Two-P0. The geometric transformation of the modular unit 110 at the Timing Two-P0 can be viewed from example projections, which are marked with arrows in FIG. 8A.

Figure 9:
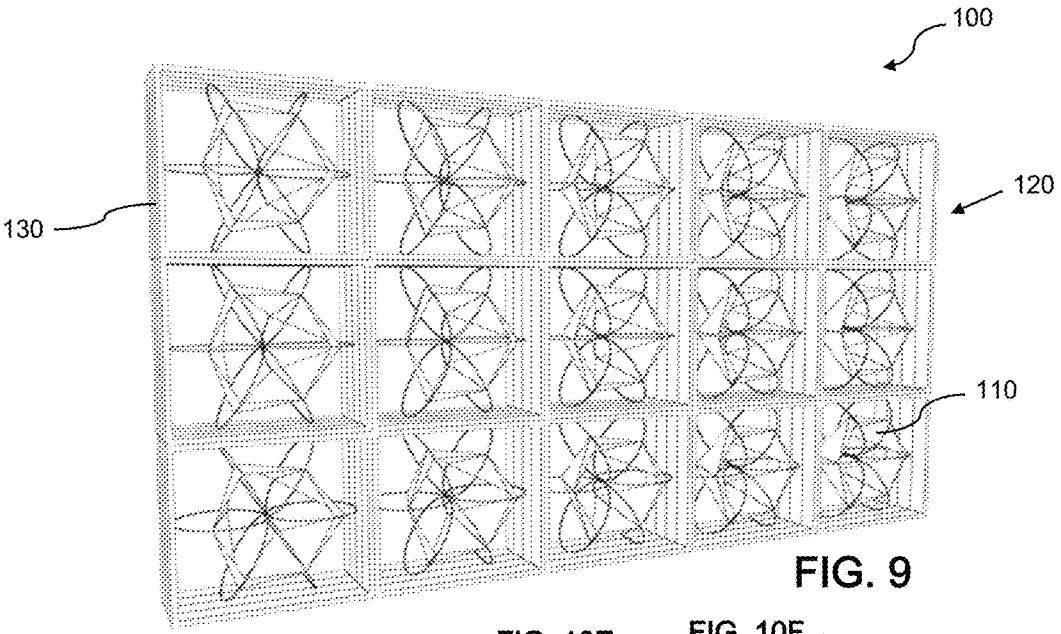
FIG. 9 illustrates an exemplary smart transformable shading system, in an aspect of a geometric transformation at one specific timing and at one specific user positioning from a spatial perspective: Timing Two-Position 0.2 (or P0.2), in accordance with one or more implementations.
Figure 10A:
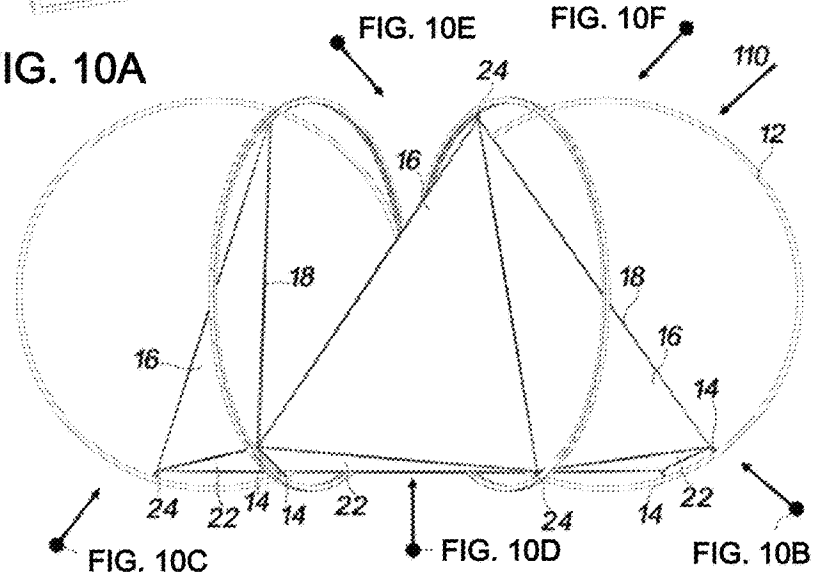
FIG. 10A illustrates an exemplary modular unit, in an aspect of a geometric transformation at Timing Two-P0.2, in accordance with one or more implementations.
Figures 10B, 10C, 10D, 10E, 10F:
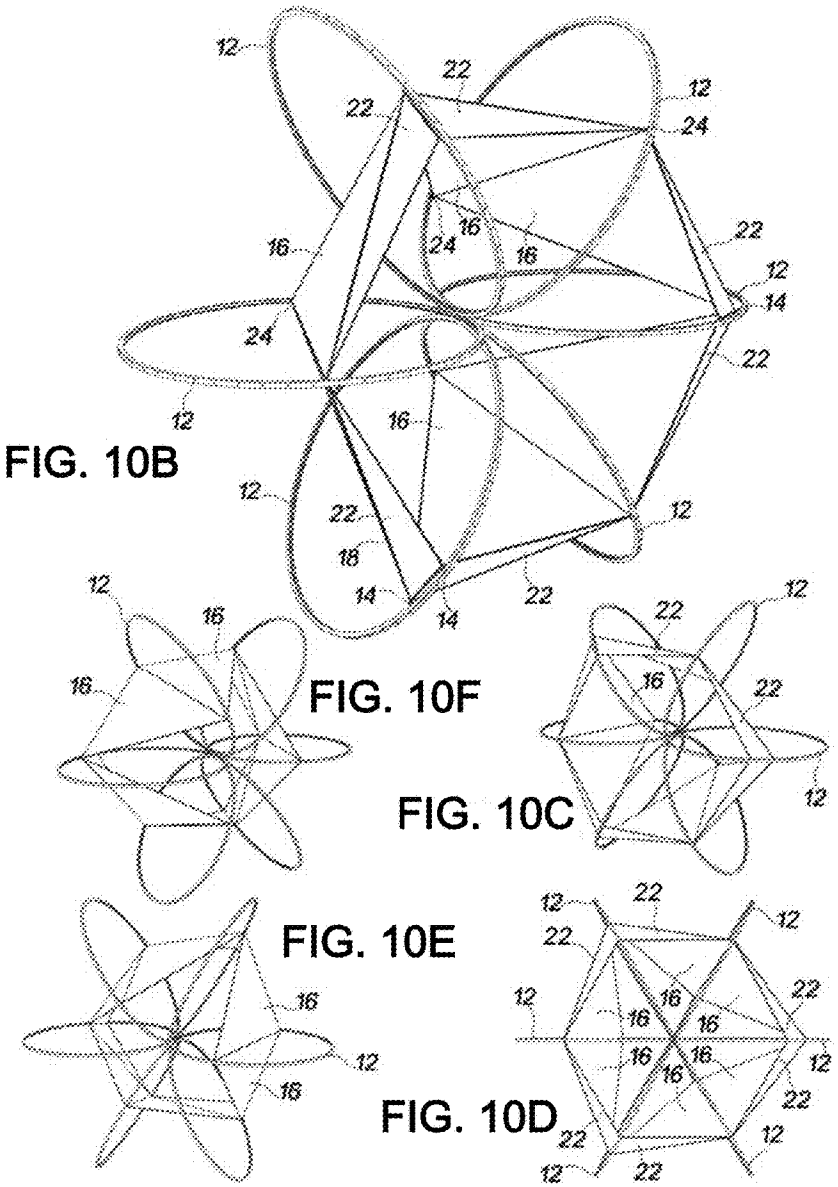
FIG. 10B through FIG. 10F illustrate aspects of an exemplary geometric transformation of the modular unit at Timing Two-P0.2, viewed from example projections marked with arrows in FIG. 10A, in accordance with one or more implementations.
Figure 12B:
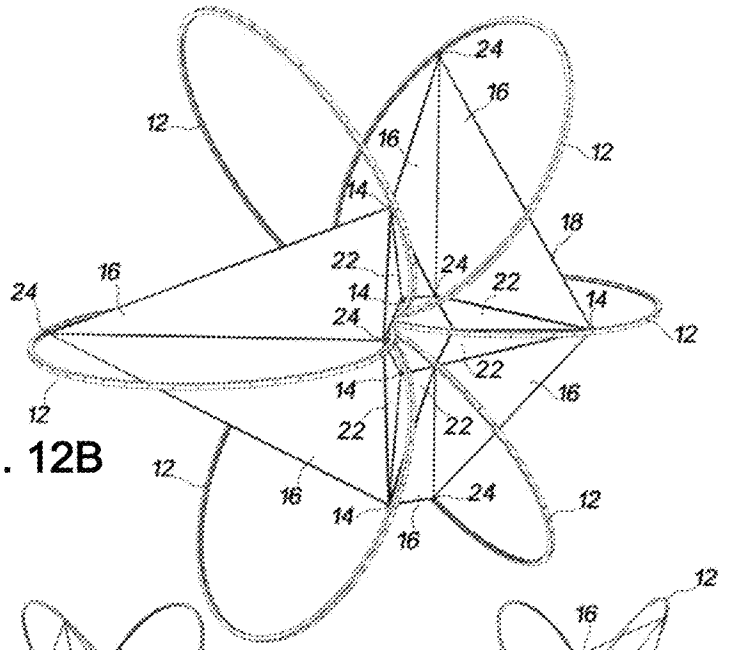
FIG. 12B through FIG. 12F illustrate aspects of an exemplary geometric transformation of the modular unit at Timing Two-P0.4, viewed from example projections marked with arrows in FIG. 12A, in accordance with one or more implementations.
Figure 12C:
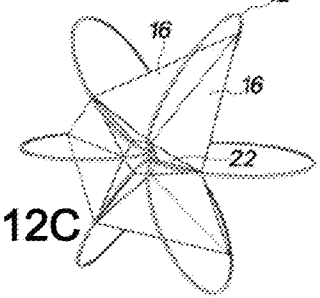
Figure 12F:
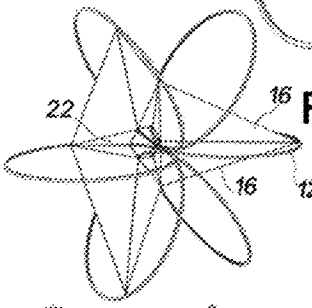
Figure 12D:
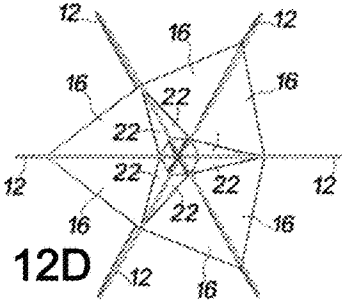
Figure 12E:
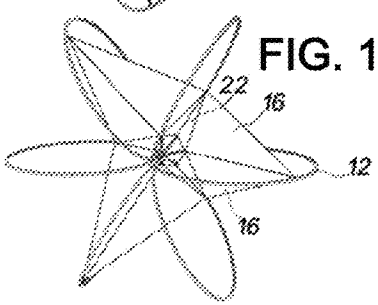

FIG. 9 illustrates another implementation of system 100 that can provide, among other features, expansion, and retraction in response to electromagnetic radiation according to another specific timing and specific user positioning from a spatial perspective: Timing Two-Position 0.2 (or P0.2), in reference to FIG. 13. In this exemplary implementation, FIG. 10B through FIG. 10F illustrate an exemplary geometric transformation of the modular unit 110 at the Timing Two-P0.2. The geometric transformation of the modular unit 110 at the Timing Two-P0.2 can be viewed from example projections, which are marked with arrows in FIG. 12A.

FIG. 11 illustrates another implementation of system 100 that can provide, among other features, expansion, and retraction in response to electromagnetic radiation according to another specific timing and specific user positioning from a spatial perspective: Timing Two-Position 0.4 (or P0.4), in reference to FIG. 13. In this exemplary implementation, FIG. 12B through FIG. 12F illustrate an exemplary geometric transformation of the modular unit 110 at the Timing Two-P0.4. The geometric transformation of the modular unit 110 at the Timing Two-P0.4 can be viewed from example projections, which are marked with arrows in FIG. 12A.

Figure 13:
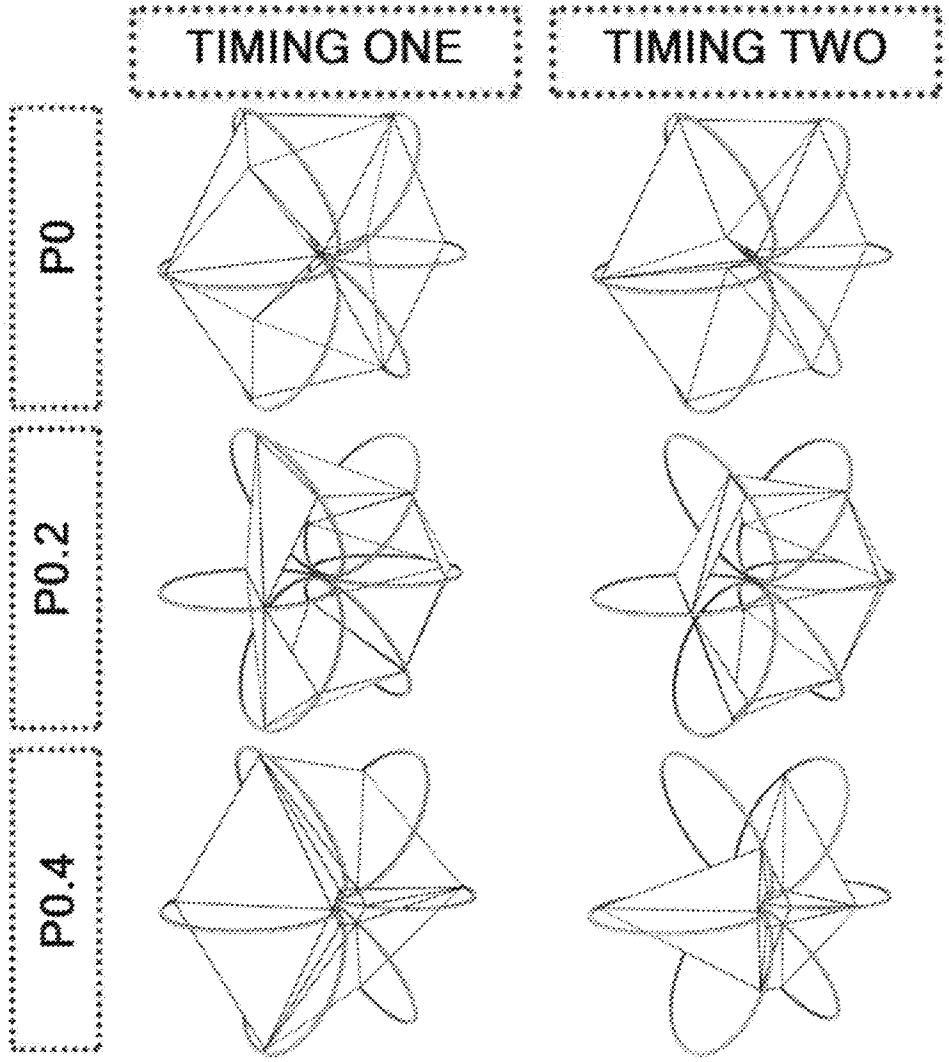
FIG. 13 illustrates aspects and various operations in an exemplary geometric transformation of a modular unit based on different user's positioning in two separate timings, in accordance with one or more implementations.

FIG. 13 illustrates exemplary geometric transformations of the modular unit 110 in response to light. In an aspect, the geometric transformations of the modular unit 110 may be performed based on different user's positionings in two separate timings. In one implementation, the geometric transformations of the modular unit 110 may be observed from the user's positionings from a spatial perspective at Position 0 (or P0), Position 0.2 (or P0.2), and Position 0.4 (or P0.4) under Timing One and Timing Two. The geometric transformations of the modular unit 110 may be sampled at one specific timing from the motions of the gear boxes 14 and 24 within each of the structural rings 12. In a further aspect, the geometric transformations of the modular unit 110 may be performed based on environmental conditions as well as user's needs and positionings.

FIG. 14 illustrates an exemplary side view of the gear boxes 24 and 14 that can be configured to move the deployable shell panels 16 and 22. In the FIG. 14 implementation, the gear boxes 24 and 14 can include a first end 14A/24A and a second end 14B/24B; a first rotatable gear 32; a second rotatable gear 36; and an actuator motor 30 having a first end 30A and a second end 30B. A cylindrical unit 62, as shown in more detail in FIG. 15, may attach to the gear box 24 and 14, and may include a first rotatable cylinder 34 and a rotatable belt 38. In one implementation, the gear box 24 and 14 can be arranged such that the first end 30A of the actuator motor 30 can face the first end 14A/24A of the gear box 14 and 24, and the second end 30B of the actuator motor 30 can face away from the first end 14A/24A of the gear box 24 and 14. The second end 30B of the actuator motor 30 can connect to the first rotatable gear 32, and the first rotatable gear 32 can be configured to be in contact with the second rotatable gear 36. For example, the first rotatable gear 32 is configured to mesh with the second rotatable gear 36, whereby rotating the first rotatable gear 32 causes the second rotatable gear 36 to rotate. The cylindrical unit 62 can be arranged such that the first rotatable cylinder 34 may be surrounded by the rotatable belt 38 and may attach to the second rotatable gear 36. In an aspect, the first rotatable gear 32 and the second rotatable gears 36 can each include a cone gear.

FIGS. 15A and 15B respectively illustrate an exemplary control unit 60 and an exemplary side view of such control unit that can be configured to control movements of each of the plurality of the deployable shell panels 16 and 22. The mechanism for control and movement of the plurality of the deployable shell panels is depicted in more detail in FIG. 16. In the FIGS. 15A and 15B implementation, the control unit 60 can include the gear box 24 and 14 having the first end 14A/24A and the second end 14B/24B; the cylindrical unit 62 having the first rotatable cylinder 34, a second rotatable cylinder 42, and the rotatable belt 38; and a rotating wheel unit 64 having a first rotatable wheel 40A and a second rotatable wheel 40B (for brevity, collectively referenced as "first and second rotatable wheels 40"). In one implementation, the gear box 24 and 14 can be arranged such that the first end 30A of the actuator motor 30 can face the first end 14A/24A of the gear box 24 and 14, and the second end 30B of the actuator motor 30 may face away from the first end 14A/24A of the gear box 24 and 14. The second end 30B of the actuator motor 30 can connect to the first rotatable gear 32, and the first rotatable gear 32 can be configured to be in contact with the second rotatable gear 36. As noted previously, for example, the first rotatable gear 32 is configured to mesh with the second rotatable gear 36, such that rotating the first rotatable gear 32 causes the second rotatable gear 36 to rotate. The cylindrical unit 62 can be arranged such that the first rotatable cylinder 34 may be attached to the second rotatable gear 36, the second rotatable cylinder 42 can be attached to the rotating wheel unit 64, and the first rotatable cylinder 34 and the second rotatable cylinder 42 can be surrounded by the rotatable belt 38. The rotating wheel units 64 can be arranged such that the first and the second rotatable wheels 40 can be connected together via the second rotatable cylinder 42, and can be positioned within the surrounding rail 26 of the structural ring 12.

In one implementation, the actuator motor 30 can be configured to rotate the first rotatable gear 32 causing rotation of the second rotatable gear 36, which in turn causes rotation of the first rotatable cylinder 34. Rotation of the first rotatable cylinder 34 will cause rotation of the rotatable belt 38, which in turn causes rotation of the second rotatable cylinder 42. Rotation of the second rotatable cylinder 42 causes rotation of the rotating wheel unit 64, which in turn causes the first and the second rotatable wheels 40 to move around the surrounding rail 26 of the structural ring 12.

Figure 16:
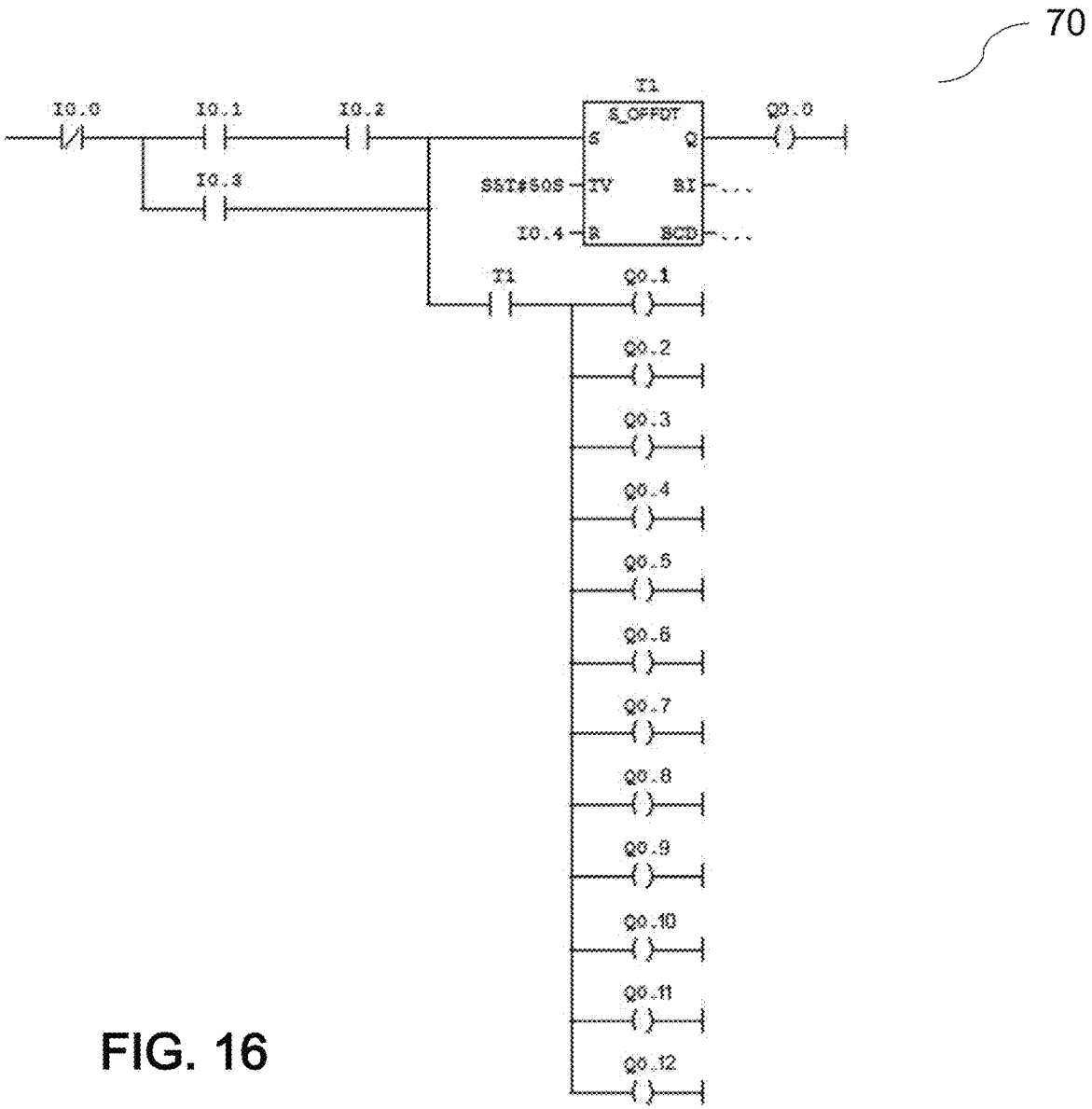
FIG. 16 illustrates an exemplary circuit unit, in accordance with one or more implementations.

FIG. 16 illustrates an exemplary circuit unit 70 that can be configured to command motion to each of the plurality of the control units 60, and to geometrically transform each of the plurality of the deployable shell panels 16 and 22 in response to light. In the FIG. 16 implementation, the circuit unit 70 as shown may include a plurality of actuator sensors I0, a timer unit T1, and a plurality of electrical switches Q0. The plurality of actuator sensors I0 can, for example, be light sensors. In one implementation, the actuator sensor I0.0 can be configured to function as a STOP key to disconnect electrical connections within the circuit unit 70. The actuator sensors I0.1 and I0.2 can be configured to function as smart sensors to receive and gather information regarding electromagnetic radiation parameters such as vision comfort, vision field, Useful Daylight Illuminance (UDI), Daylight Glare Probability (DGP), and Daylight Glare Index (DGI). In an aspect, the actuator sensors I0.1 and I0.2 may be arranged in such a fashion to represent respectively an internal digital sensor and an external digital sensor in which the internal digital sensor I0.1 can be programmed to provide an amount of sunlight radiation and angle of sunlight radiation. The external digital sensor I0.2 can be programmed to provide an intensity of sunlight radiation entering a subject unit.

In one implementation, the actuator sensors I0.1 and I0.2 can be configured to turn on simultaneously, which in turn sends a message to the timer unit T1 to turn on, which ultimately turns on the electrical switch Q0.0. The electrical switch Q0.0 can be configured to keep the timer unit T1 on for one specific time period. In an aspect, a TV time inside the timer unit T1 can be configured to connect the timer unit T1 on after 50 seconds, which can be programmed in section S5T #50S of the timer unit T1. The connection of timer unit T1 in turn may cause each of the plurality of electrical switches Q0.1 through Q0.12 to turn on, and to command motion to each of the plurality of the control units 60, and to geometrically transform each of the plurality of the deployable shell panels 16 and 22.

In one implementation, the circuit unit 70 can be written in Ladder Diagram Programming, and can be configured to function automatically or by hand while commanding motion to the plurality of the control units 60. Ladder Logic is a programming language that creates and represents a program through ladder diagrams that are based on circuit diagrams. In an aspect, the actuator sensor I0.3 can be configured to function as a START key when pushed by hand; and the actuator sensor I0.0 can be configured to function as the STOP key when pushed by hand.

The electromagnetic radiation parameters received by the actuator sensors I0.1 and I0.2 may be configured to determine structural positioning and percentage of expansion and retraction of each of the plurality of the deployable shell panels 16 and 22 during the geometric transformations. The electromagnetic radiation parameters may include light direction, sunshade creation, vision sight, glare reduction, and eye strain relief; and may be optimized by software programs such as Grasshopper™, or various comparable programs available from commercial vendors. Based on the received electromagnetic radiation parameters, the actuator sensors I0.1 and I0.2 may be configured to send signals to a Program Logic Center (PLC), which provides intelligence to the circuit unit 70, commands motion to the control units 60, and controls rotational amount and speed of the gear boxes 24 and 14. In an aspect, the PLC can be written based on different geographical positioning and application of the subject unit.

Figure 17:
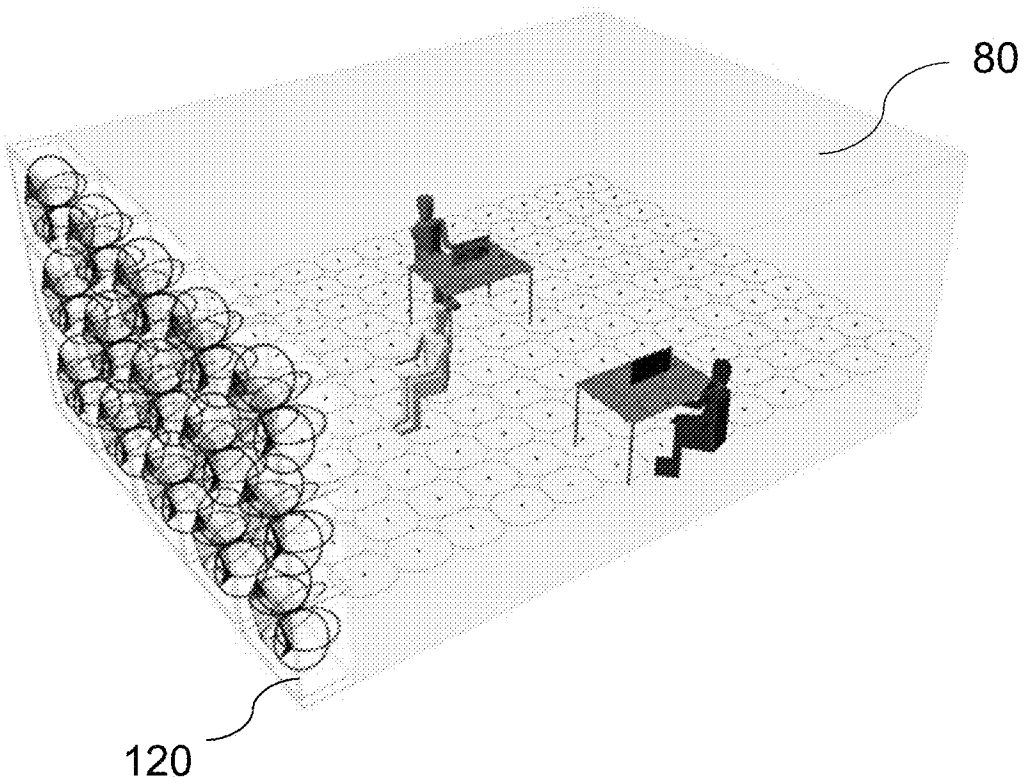
FIG. 17 illustrates an exemplary subject unit from a spatial perspective, in accordance with one or more implementations.

FIG. 17 illustrates an exemplary subject unit 80 from a spatial perspective that can be modeled by a computer software. In the FIG. 17 implementation, the subject unit 80 as shown may include the system 100 engaging on a façade of the subject unit 80 while different users sitting inside. The housing unit 120 may be configured to expand depending on size and surface area of the subject unit's façade. In one implementation, the housing unit 120 may be installed as an adjoining system to the subject unit's façade during the construction of the subject unit 80. In another implementation, the housing unit 120 may be installed as the adjoining system to the subject unit's façade after the construction of the subject unit 80. In an aspect, the subject unit 80 may include a space, for example, with dimensions of 7 m in length, 5.5 m in width, and 3 m in height. Foundation grid of the subject unit 80 may be established in such a fashion at 80 cm height to capture an amount of electromagnetic radiation entering the subject unit 80 where the height is being considered as a standard height for the users sitting behind tables. In a related aspect, the subject unit 80 may include different varieties such as a residential and an educational building; an office and a commercial building; and a factory and a service building.

FIG. 18 through FIG. 20 illustrate exemplary data sets that can be used to obtain information regarding an optimized transformed geometry for the plurality of the deployable shell panels 16 and 22 at the specific timing (Timing One and Timing Two), and at the specific user positioning from the spatial perspective (P0, P0.2, and P0.4). In this exemplary illustration, the data set as shown may include parameters such as Useful Daylight Illuminance (or UDI), Daylight Performance, Daylight Glare Probability (or DGP), Module Materials, and Calculation Time (or Hour). In one implementation, the UDIs may include three values in percentage: $UDI_{300}$, $UDI_{2000}$, and $UDI_{100}$ in which the Daylight Performance represents the difference between the values of $UDI_{300}$ and $UDI_{2000}$. The DGPs may represent three separate user positionings from a spatial perspective. The Module Materials may include $1^{st}$ Module Material and $2^{nd}$ Module Material, which refer respectively to the deployable shell panels 16 and 22. The Hour may include three separate timings within a year in which, for example, 1908, 6324, and 8508 represent respectively a specific hour of a day in months of March, September, and December. In an aspect, the calculated DGPs may provide information regarding the optimized transformed geometry for the deployable shell panels 16 and 22 when the DGP values are less than 0.35, which in turn provide vision comfort to the users inside the subject unit 80.

Figure 21A:
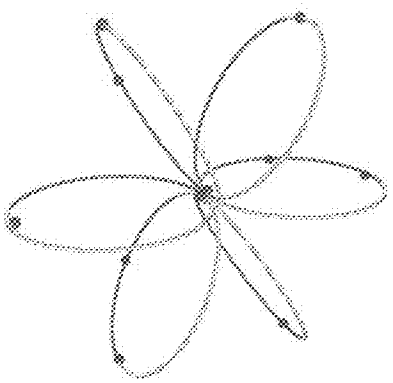
FIG. 21A through FIG. 21C illustrate an exemplary structural positioning of control units relative to structural rings during geometric transformations of the transformable shading system, respectively at Timing One-P0, Timing One-P0.2, and Timing One-P0.4, in accordance with one or more implementations.
Figure 21B:
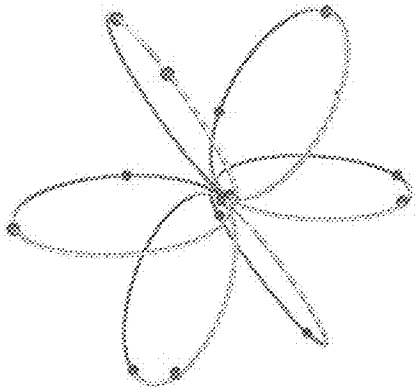
Figure 21C:
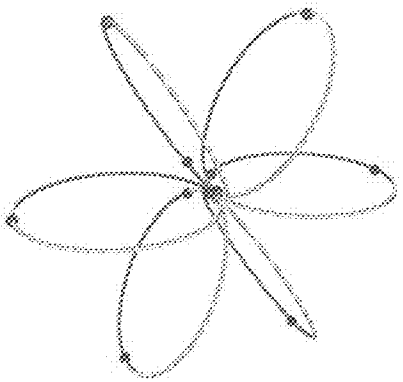

FIG. 21A through FIG. 21C illustrate an exemplary structural positioning of the control units 60 within the structural rings 12 during geometric transformations in response to light. In the FIG. 21A implementation, the structural positioning as shown can include the plurality of the structural rings 12 and the plurality of the control units 60. In one implementation, the plurality of the structural rings 12 may include six structural rings, and the plurality of the control units 60 may include twelve control units in which two of which control units 60 are positioned within each of the six structural rings 12. In an aspect, each of the two control units 60 within each of the six structural rings 12 can establish the structural positionings of the plurality of the control units 60 with respect to one another in response to different geometric transformations at one specific timing. In a related aspect, FIG. 21A through FIG. 21C respectively establish the exemplary structural positioning of the control units 60 at the Timing One-P0, Timing One-P0.2, and Timing One-P0.4, in reference to FIG. 13.

Figure 22:
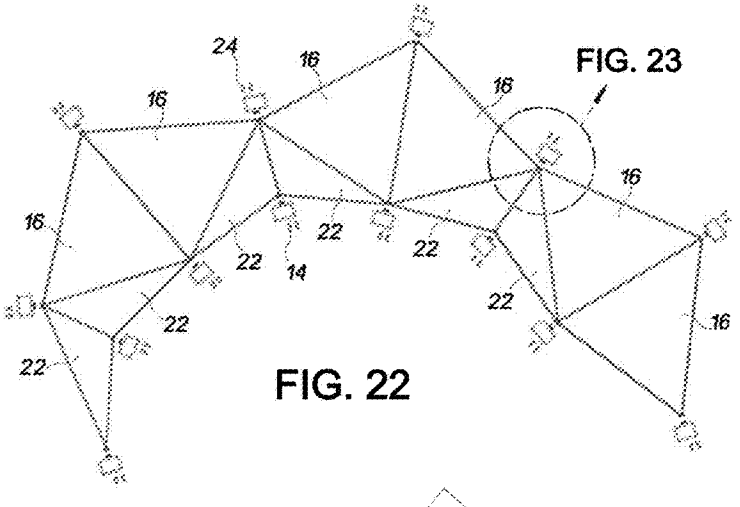
FIG. 22 illustrates an exemplary structural positioning of deployable shell panels and control units relative to one another in a two-dimensional representation, in accordance with one or more implementations.

FIG. 22 illustrates an exemplary structural positioning of the deployable shell panels 16 and 22 with respect to one another in a two-dimensional representation. In the FIG. 22 implementation, the structural positioning as shown may include the plurality of the deployable shell panels 16 and 22, the plurality of the gear boxes 24 and 14, and the plurality of rotatable wheels 40. In one implementation, the plurality of the deployable shell panels 16 and 22 may expand in the two-dimensional representation in which each of the plurality of the deployable shell panels in the first group 16 is associated with each of the plurality of the gear boxes in the first group 24; and each of the plurality of the deployable shell panels in the second group 22 is associated with each of the plurality of the gear boxes in the second group 14. In an aspect, a structural connection between each of the plurality of gear boxes 24 and 14, and the plurality of deployable shell panels 16 and 22 is described in more detail in FIG. 23.

Figure 23:
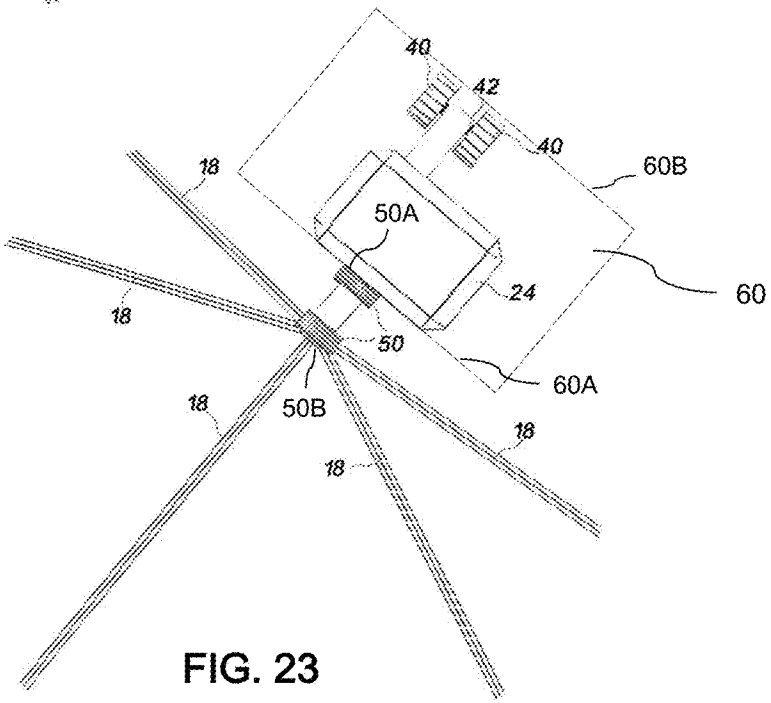
FIG. 23 illustrates an exemplary structural connection between a control unit and structural pipes, in accordance with one or more implementations.

FIG. 23 illustrates an exemplary structural connection that can be configured to connect each of the plurality of the control units 60 to the plurality of the structural pipes 18 of the deployable shell panels 16 and 22. In the FIG. 23 implementation, the structural connection as shown may include a connection 50 having a first end 50A and a second end 50B; the control unit 60 having the first end 60A and the second end 60B; and the plurality of the structural pipes 18. In one implementation, the first end 50A of the connection 50 may be connected to the first end 60A of the control unit 60; and the second end 50B of the connection 50 may be connected to the plurality of the structural pipes 18. In an aspect, the connection 50 may be configured to function as a hinge, and to allow the control unit 60 freely adjust an angle between the control unit 60 and the plurality of the structural pipes 18 in response to different geometric transformations.

Figure 24:
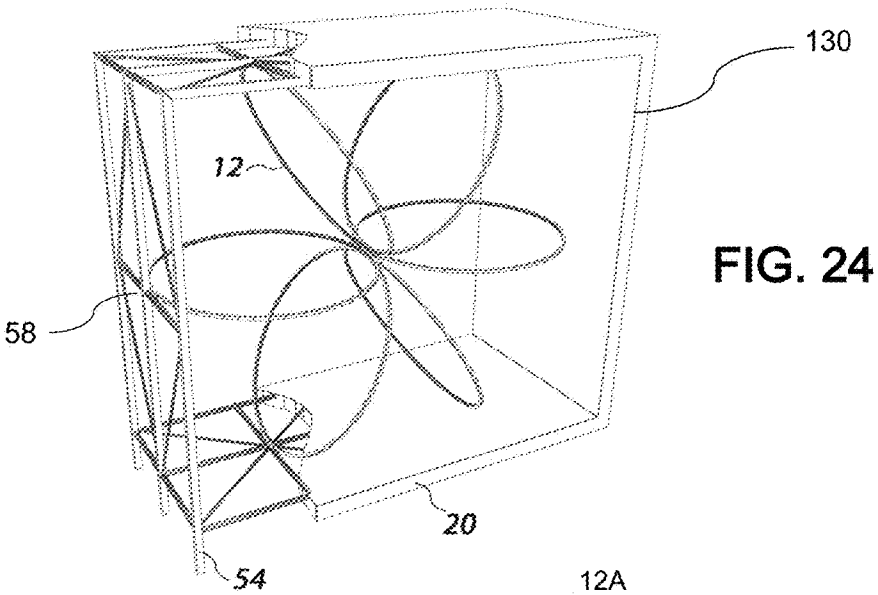
FIG. 24 illustrates an exemplary structural cell surrounding a modular unit, and connecting to structural rings of the modular unit, in accordance with one or more implementations.

FIG. 24 illustrates an exemplary structural cell 130 that can be configured to surround each of the plurality of the modular units 110, and to connect to the plurality of the structural rings 12 within the modular unit 110. In the FIG. 24 implementation, the structural cell 130 as shown may include a structural frame 54, a plurality of connections 58, and the structural frame cover 20. In one implementation, the structural frame 54 may be covered by the structural frame cover 20, and may provide structural support to the six structural rings 12 positioning within the structural cell 130. In an aspect, the structural frame cover 20 can be rectangular in shape, and can be made of compressed plastics having high stiffness.

Figure 25A:
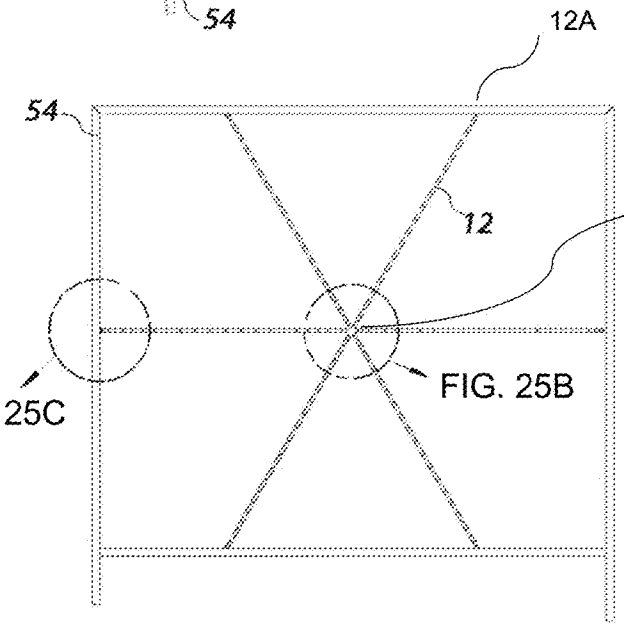
FIG. 25A illustrates an exemplary section of a structural frame connecting to structural rings of a modular unit in a two-dimensional representation, in accordance with one or more implementations.

FIG. 25A illustrates an exemplary section of the structural frame 54 that can be connected to each of the plurality of the structural rings 12 of the modular unit 110. In the FIG. 25A implementation, the structural frame 54 as shown may include the plurality of connections 58, which is depicted in more detail in FIG. 25C. In one implementation, each of the plurality of the structural rings 12 may include a first connection 12A and a second connection 12B in which each of the first connections 12A of the structural rings 12 is attached to each of the connections 58 of the structural frame 54, and each of the second connections 12B of the structural rings 12 is attached together by the fastening connections 56, which is depicted in more detail in FIG. 25B.

Figure 25B:
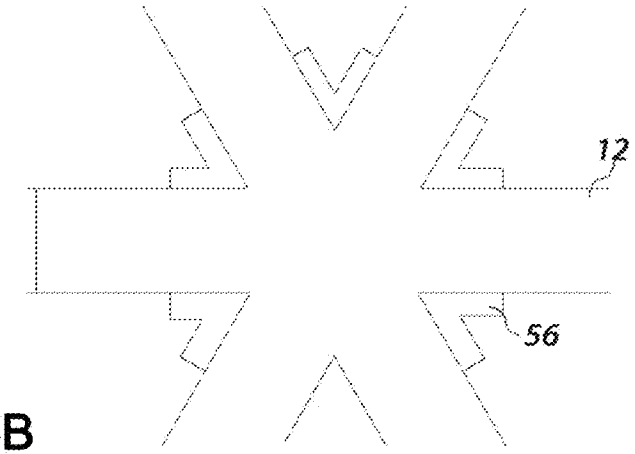
FIG. 25B illustrates an exemplary section of a structural connection between structural rings in a two-dimensional representation, in accordance with one or more implementations.

FIG. 25B illustrates an exemplary section of the structural connection that can connect the plurality of the structural rings 12 together. In the FIG. 25B implementation, the structural connection as shown may include the fastening connection 56 that can be configured to reinforce the connection of the structural rings together.

Figure 25C:
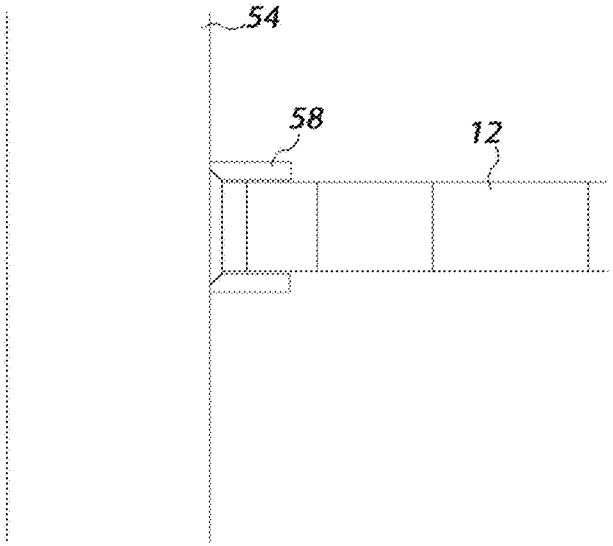
FIG. 25C illustrates an exemplary section of a structural connection between a structural ring and a structural frame in a two-dimensional representation, in accordance with one or more implementations.

FIG. 25C illustrates an exemplary section of the structural connection that can be configured to connect each of the plurality of the structural rings 12 to each of the plurality of the structural frames 54. In the FIG. 25C implementation, the structural connection as shown may include the connection 58 that can be configured to connect the structural ring 12 to the structural frame 54.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations for the purpose of streamlining the disclosure. This method of disclosure is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

What is claimed is:

1. A transformable shading system comprising:

a housing unit having portions aligned respectively in first and second directions;

a plurality of structural cells distributed in an array aligned with respect to the first and second directions; and a plurality of modular units, each positioned within each of the plurality of the structural cells of the housing unit, and configured to expand and retract into different geometric transformations in response to electromagnetic radiation;

wherein:

each structural cell includes a structural frame, a plurality of connections, and a structural frame cover, and surrounds a corresponding one of the modular units, each modular unit includes a plurality of structural rings, a fastening connection, a plurality of deployable shell panels, a plurality of control units, and a plurality of circuit units, wherein:

each structural ring includes a first connection, a second connection, and a surrounding rail, the fastening connection is configured to connect the plurality of the structural rings together, each deployable shell panel includes a plurality of connections and a plurality of deployable pipes, wherein each deployable pipe is configured to define a margin of the deployable shell panel, each control unit is configured to control movements of a corresponding one of the deployable shell panels, and each circuit unit is configured to command motion in response to a corresponding one of the control units.

2. The transformable shading system of claim 1, wherein the plurality of the structural rings includes six structural rings that are positioned within each of the plurality of the structural cells such that each of the first connections of the six structural rings is attached to a corresponding one of the connections of the structural frame of the structural cell, and each of the second connections of the six structural rings is attached together by the fastening connection.

3. The transformable shading system of claim 1, wherein each of the plurality of the circuit units includes a plurality of actuator sensors, a timer unit, and a plurality of electrical switches in which the plurality of actuator sensors is connected to the timer unit, and the timer unit is connected to the plurality of the electrical switches, and each of the electrical switches is connected to a corresponding one of the control units.

4. The transformable shading system of claim 1, wherein each of the structural frame covers is made of compressible stiff materials.

5. The transformable shading system of claim 1, wherein the plurality of the deployable shell panels is further configured to form a first group and a second group, wherein the first group and the second group each includes six deployable shell panels.

6. The transformable shading system of claim 5, wherein one of the deployable shell panels forming the first group and one of the deployable shell panels forming the second group are positioned within each of the plurality of the structural rings.

7. The transformable shading system of claim 5, wherein:

the six deployable shell panels within the first group of the deployable shell panels are configured to move together, and to transform into same geometries, and the six deployable shell panels within the second group of the deployable shell panels are configured to move together, and to transform into same geometries.

8. The transformable shading system of claim 5, wherein:

the six deployable shell panels within the first group of the deployable shell panels each includes a first material, and the six deployable shell panels within the second group of the deployable shell panels each includes a second material.

9. The transformable shading system of claim 8, wherein the first material and the second material are flexible materials.

10. The transformable shading system of claim 5, wherein each of the plurality of the control units includes:

a first end and a second end, a gear box having a first rotatable gear, a second rotatable gear, and an actuator motor, a cylindrical unit having a first rotatable cylinder, a second rotatable cylinder, and a rotatable belt, and a rotating wheel unit having a first rotatable wheel and a second rotatable wheel.

11. The transformable shading system of claim 10, wherein the first end of each of the plurality of the control units is configured to connect to each of the plurality of the connections of the deployable shell panels, and the second end of each of the plurality of the control units is configured to position within the surrounding rail of each of the plurality of the structural rings.

12. The transformable shading system of claim 10, wherein the first and the second rotatable gears include a cone gear.

13. The transformable shading system of claim 10, wherein:

each of the gear boxes is configured wherein the actuator motor is connected to the first rotatable gear, and the first rotatable gear is configured to be in contact with the second rotatable gear, each of the cylindrical units is configured wherein the first rotatable cylinder is attached to the second rotatable gear, the second rotatable cylinder is attached to the rotating wheel unit, and the first and the second rotatable cylinders are surrounded by the rotatable belt, and each of the rotating wheel units is configured wherein the first and the second rotatable wheels are connected together via the second rotatable cylinder.

14. The transformable shading system of claim 13, wherein:

the actuator motor is configured to rotate the first rotatable gear causing the rotation of the second rotatable gear, which in turn causes the rotation of the first rotatable cylinder, the rotation of the first rotatable cylinder causes the rotation of the rotatable belt, which in turn causes the rotation of the second rotatable cylinder, and the rotation of the second rotatable cylinder causes the rotation of the rotating wheel unit, which in turn causes the first and the second rotatable wheels to move around the surrounding rail of each of the structural rings.

15. The transformable shading system of claim 10, wherein the plurality of the gear boxes is further configured to form a first group and a second group with each group having six gear boxes.

16. The transformable shading system of claim 15, wherein each of the first and the second groups of the gear boxes is configured to work with a dc power supply of 12 v and a rotational frequency of 50 rpm.

17. The transformable shading system as in claim 15, wherein:

the six gear boxes within the first group of the gear boxes are configured to function together, and to move the six deployable shell panels within the first group of the deployable shell panels, and the six gear boxes within the second group of the gear boxes are configured to function together, and to move the six deployable shell panels within the second group of the deployable shell panels.

18. The transformable shading system of claim 1, wherein entire of the plurality of the modular units of the housing unit is configured to simultaneously function, and to transform into same geometries in response to an amount of solar radiation entering the transformable shading system via using a smart timing system.

19. The transformable shading system of claim 18, wherein the entire of the plurality of the modular units of the housing unit is configured to adapt to different climate change, to control electromagnetic radiation parameters including Useful Daylight Illuminance (UDI), Daylight Glare Probability (DGP), and Daylight Glare Index (DGI), and to optimize annual energy consumption of a subject unit.

20. The transformable shading system of claim 19, wherein:

the housing unit is installed as an adjoining system to a façade of the subject unit during a construction of the subject unit, the housing unit is installed as the adjoining system to the façade of the subject unit after the construction of the subject unit, and the housing unit is configured to be expanded depending on a size and a surface area of the façade of the subject unit in which the subject unit includes different varieties such as a residential and an educational building; an office and a commercial building; and a factory and a service building.

* * * * *